US007203433B2

(12) United States Patent
Kato et al.

(10) Patent No.: US 7,203,433 B2
(45) Date of Patent: Apr. 10, 2007

(54) APPARATUS FOR DETECTING AMOUNT OF TONER DEPOSIT AND CONTROLLING DENSITY OF IMAGE, METHOD OF FORMING MISALIGNMENT CORRECTION PATTERN, AND APPARATUS FOR DETECTING AND CORRECTING MISALIGNMENT OF IMAGE

(75) Inventors: Shinji Kato, Kanagawa (JP); Yuuji Sawai, Kanagawa (JP); Hiromi Ogiyama, Tokyo (JP); Shin Kayahara, Chiba (JP); Atsushi Takehara, Kanagawa (JP); Ken Yoshida, Tokyo (JP); Yoshihiro Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 296 days.

(21) Appl. No.: 10/868,912

(22) Filed: Jun. 17, 2004

(65) Prior Publication Data

US 2005/0147424 A1 Jul. 7, 2005

(30) Foreign Application Priority Data

Jun. 25, 2003 (JP) ..... 2003-181425
Jul. 9, 2003 (JP) ..... 2003-194187

(51) Int. Cl.
*G03G 15/00* (2006.01)

(52) U.S. Cl. ..... 399/49

(58) Field of Classification Search ..... 399/49, 399/302, 308

See application file for complete search history.

(56) References Cited

U.S. PATENT DOCUMENTS 4,254,201 A 3/1981 Sawai et al.
4,528,937 A 7/1985 Kanno et al.
4,851,874 A 7/1989 Ogiyama
4,975,748 A 12/1990 Koinuma et al.
4,989,043 A 1/1991 Suzuki et al.
5,003,354 A 3/1991 Takamiya et al.
5,057,873 A 10/1991 Sawai et al.
5,208,211 A 5/1993 Kurotori et al.
5,231,452 A 7/1993 Murayama et al.

(Continued)

FOREIGN PATENT DOCUMENTS

JP 2000-81745 3/2000

(Continued)

OTHER PUBLICATIONS

U.S. Appl. No. 11/169,670, filed Jun. 30, 2005, Fujimori et al.

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

An image forming apparatus includes a reference-pattern detecting transfer-body, a reference-pattern detecting unit, and a condition changing unit. The reference-pattern detecting transfer-body directly transfers a reference pattern image formed on an intermediate transfer body without a recording material. The reference-pattern detecting unit detects an optical reference pattern with respect to the image transferred onto the reference-pattern detecting transfer-body. The condition changing unit changes the image forming conditions based on a result of detection.

7 Claims, 25 Drawing Sheets

U.S. PATENT DOCUMENTS

| | | | | |
|---|---|---|---|---|
| 5,327,196 | A | 7/1994 | Kato et al. | |
| 5,387,965 | A | 2/1995 | Hasegawa et al. | |
| 5,410,339 | A | 4/1995 | Bisaiji et al. | |
| 5,475,476 | A | 12/1995 | Murai et al. | |
| 5,483,330 | A | 1/1996 | Ogiyama et al. | |
| 5,493,382 | A | 2/1996 | Takagaki et al. | |
| 5,604,575 | A | 2/1997 | Takagaki et al. | |
| 5,671,470 | A | 9/1997 | Maruta et al. | |
| 5,682,572 | A | 10/1997 | Murai et al. | |
| 5,737,680 | A | 4/1998 | Takagaki et al. | |
| 5,758,235 | A | 5/1998 | Kosuge et al. | |
| 5,765,059 | A | 6/1998 | Kosuge et al. | |
| 5,768,664 | A | 6/1998 | Kosuge et al. | |
| 5,826,146 | A | 10/1998 | Maruta et al. | |
| 5,860,038 | A | 1/1999 | Kato et al. | |
| 5,890,030 | A | 3/1999 | Namekata et al. | |
| 5,970,276 | A | 10/1999 | Kato | |
| 6,055,386 | A | 4/2000 | Kato et al. | |
| 6,061,543 | A | 5/2000 | Kayahara et al. | |
| 6,081,678 | A | 6/2000 | Kato | |
| 6,141,520 | A | 10/2000 | Kosuge | |
| 6,163,661 | A | 12/2000 | Namekata et al. | |
| 6,195,519 | B1 | 2/2001 | Isobe et al. | |
| 6,212,351 | B1 | 4/2001 | Kawagoe et al. | |
| 6,249,304 | B1 | 6/2001 | Sawayama et al. | |
| 6,269,228 | B1 | 7/2001 | Kayahara et al. | |
| 6,292,206 | B1 | 9/2001 | Takehara et al. | |
| 6,295,438 | B1 | 9/2001 | Fujishiro et al. | |
| 6,334,039 | B1 | 12/2001 | Yoshinaga et al. | |
| 6,366,754 | B1 | 4/2002 | Sato et al. | |
| 6,405,002 | B2 | 6/2002 | Ogiyama et al. | |
| 6,408,156 | B1 | 6/2002 | Miyazaki et al. | |
| 6,505,024 | B2 | 1/2003 | Kayahara et al. | |
| 6,516,179 | B1 | 2/2003 | Sawai et al. | |
| 6,633,734 | B2 | 10/2003 | Maebashi et al. | |
| 6,813,471 | B2 | 11/2004 | Sawai et al. | |
| 6,819,897 | B2 | 11/2004 | Kita | |
| 6,823,149 | B2 | 11/2004 | Yoshikawa et al. | |
| 6,829,450 | B2 | 12/2004 | Tamiya et al. | |
| 6,941,083 | B1 * | 9/2005 | Muratani | 399/49 |
| 2003/0185585 | A1 | 10/2003 | Kimura et al. | |
| 2003/0215267 | A1 | 11/2003 | Kita | |
| 2003/0215269 | A1 | 11/2003 | Kayahara et al. | |
| 2003/0219279 | A1 | 11/2003 | Nohsho et al. | |
| 2003/0219287 | A1 | 11/2003 | Ogiyama et al. | |
| 2003/0223768 | A1 * | 12/2003 | Takigawa | 399/66 |
| 2004/0109709 | A1 | 6/2004 | Ishibashi et al. | |

FOREIGN PATENT DOCUMENTS

| | | |
|---|---|---|
| JP | 2001-134041 | 5/2001 |
| JP | 2001-194843 | 7/2001 |
| JP | 2001-249513 | 9/2001 |
| JP | 2001-356541 | 12/2001 |
| JP | 2002-62707 | 2/2002 |
| JP | 2002-236402 | 8/2002 |

OTHER PUBLICATIONS

U.S. Appl. No. 11/276,666, filed Mar. 9, 2006, Takehara et al.
U.S. Appl. No. 11/265,174, filed Nov. 3, 2005, Yoshida.
U.S. Appl. No. 11/477,673, filed Jun. 30, 2006, Wantanbe et al.

* cited by examiner

| No. | Vmax | VD | VB | VL |
|---|---|---|---|---|
| 1 | 160 | 400 | 280 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| ⋮ | ⋮ | ⋮ | ⋮ | ⋮ |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |

OUT OF COLOR REGISTRATION DETECTION PATTERN

RELATION BETWEEN GLOSS LEVEL AND SENSOR OUTPUT

APPARATUS FOR DETECTING AMOUNT OF TONER DEPOSIT AND CONTROLLING DENSITY OF IMAGE, METHOD OF FORMING MISALIGNMENT CORRECTION PATTERN, AND APPARATUS FOR DETECTING AND CORRECTING MISALIGNMENT OF IMAGE

CROSS-REFERENCE TO RELATED APPLICATIONS

The present document incorporates by reference the entire contents of Japanese priority document, 2003-194187 filed in Japan on Jul. 9, 2003.

Further, the present document incorporates by reference the entire contents of Japanese priority document, 2003-181425 filed in Japan on Jun. 25, 2003.

BACKGROUND OF THE INVENTION

1) Field of the Invention

The present invention relates to a technology for detecting amount of toner deposit in a color image forming apparatus, a technology for controlling image density using the amount of toner deposit detected, a technology for forming a correcting pattern for correcting misalignment of image forming position, and a technology for correcting the misalignment using the correcting pattern.

2) Description of the Related Art

Recently, a color image forming apparatus of a tandem method, which has such a configuration that image forming units including a plurality of image carriers and development apparatus are arranged parallel to each other at positions facing a transfer belt or an intermediate transfer body, and toner images on the image carriers are sequentially transferred onto recording paper carried on the transfer belt or onto the intermediate transfer body, has been developed (see, for example, Japanese Patent Application Laid-open No. 2001-356541).

In the color image forming apparatus using the tandem method, it is necessary to confirm whether printing is possible in appropriate density without causing a misalignment at the time of starting up the apparatus.

Therefore, in the color image forming apparatus using the tandem method, an image forming apparatus that forms a toner pattern on an image carrier or an intermediate transfer body and uses an optical toner density sensor to control the image density based on a measurement of the amount of toner deposits is currently in use.

Since a size of the image forming apparatus becomes smaller and smaller it is not easy to arrange the toner density sensor flexibly. To reduce the number of sensors to the minimum, a method in which a toner pattern on the intermediate transfer body close to a final image is detected to perform various kinds of control is widely used.

In the color image forming apparatus using the tandem method, since the toner images formed on the image carriers for respective colors can be collectively transferred, the printing speed can be increased. However, compared with the color image forming apparatus using the conventional intermediate transfer body, a color misalignment is likely to occur due to the configuration.

With regard to this kind of technique, a couple of inventions are disclosed in, for example, Japanese Patent Application Laid-open No. 2001-249513 and Japanese Patent Application Laid-open No. 2000-81745, describing a misalignment pattern and a detection method in a tandem-type color image forming apparatus.

With regard to the degree of glossiness of the transfer belt, a technique is disclosed in, for example, Japanese Patent Application Laid-Open No. 2001-194843, for detecting the amount of toner deposits.

However, in an image forming apparatus that uses the optical toner density sensor to control the image density based on the measurement of the amount of toner deposits, there is a problem in performing various kinds of control by detecting a toner pattern on the intermediate transfer body close to the final image. That is, since an intermediate transfer belt comes in contact with photosensitive drums, recording paper, and cleaning blades, the intermediate transfer belt is likely to be damaged, and when the surface of the background to be detected is damaged, the amount of reflected light varies with respect to the light emitting amount of the same optical sensor, causing a detection error.

To prevent the above problem, it can be considered to use an intermediate transfer body having high hardness, but a belt having high hardness has problems in that an image is likely to be scattered, and paper is easily curled.

To increase the detection accuracy of the sensor, the distance from the sensor to a detection target cannot be set too long. Therefore, if a potential of the intermediate transfer belt is high, a potential difference between the sensor and the detection target increases, causing a problem in that the toner adheres on the sensor or the sensor output includes a noise.

Various correction methods have been proposed to correct a color misalignment occurring in the color image forming apparatus using the tandem method. One example is a correction method in which a plurality of respective color line images is formed on the transfer belt, to correct the color misalignment from an absolute position of the line images. When a method of detecting the amount of the color misalignment of each of line images with respect to the reference color line is detected, to correct the out of color registration is adopted, a method of detecting an edge of the line from a reflected light output of light irradiated to the line is used as the specific method. In this method, however, the sampling frequency should be set high (matched with the high speed of the machine), in order to improve the detection accuracy of the edge, and high processing speed is also required, thereby causing a problem in that the cost required for correcting out of color registration increases in proportion to the high speed of the machine.

A method of detecting the edge by a charge coupled device (CCD) sensor having high accuracy and high resolution has been proposed in order to improve the detection accuracy of the edge, but even when such means is used, there are still technical problems such as complication of machinery and a cost increase.

In Japanese Patent Application Laid-open No. 2001-249513, therefore, an invention is disclosed in which after a reference color and a measured color to be corrected having a different pattern pitch are superposed on each other, without detecting the edge of the line, a change in the quantity of light corresponding to a first cycle of the superposed color pattern is detected, and out of color registration between the both colors is detected based on the detection information to correct out of color registration.

On the other hand, an invention is disclosed in Japanese Patent Application Laid-open No. 2000-81745, in which a pattern including a plurality of lines having the same width and line intervals equal to the line width is superposed on the reference color and the color to be corrected, and a density detection value of the density of the superposed pattern is compared with a density D0 in an ideal state when the pattern images are in perfect accord with each other, to correct out of color registration.

In the invention disclosed in Japanese Patent Application Laid-open No. 2001-249513, a deviation in the line reading method (that is, a deviation in the vertical scanning) and a deviation in the horizontal scanning (that is, a skew) can be detected, but it is considered that correction with respect to the deviation in the horizontal scanning is difficult, and a specific method for the correction is not specified therein.

The invention disclosed in Japanese Patent Application Laid-open No. 2000-81745 discloses that the amount of deviation in the horizontal scanning and vertical scanning directions can be detected by creating a single patch as described above. However, the difference between the reference density D0 in the ideal state and the detected value largely changes due to the toner density of the respective colors, the emission current of the light emitting diode (LED), being the sensor, and a detection distance of the sensor (a distance between an object to be measured and the sensor). Further, even when a pattern is created only with the reference color in order to correct the value of the density D0 of the reference pattern (a pattern in which the reference color and the color to be corrected are superposed on each other) by the toner density at that time, since this pattern has a different total thickness of the toner from the reference pattern density D0, and hence these do not become equal, thereby causing a detection error in the correction amount of out of color registration.

An inelastic belt formed by using fluororesin, polycarbonate resin, or polyimide resin has been heretofore used for the intermediate transfer belt corresponding to the background in the misalignment detection. Recently, however, an elastic belt in which elastic members are used for the whole layers of the belt or a part of the belt has been frequently used.

This is because problems described below occur when a color image is transferred by using the inelastic belt (resin belt). That is, a color image is normally formed of colored toners of four colors. Toner layers from a first layer to a fourth layer are formed in one color image. The toner layers are pressured while undergoing primary transfer (transfer from the photosensitive drum to the intermediate transfer belt) and secondary transfer (transfer from the intermediate transfer belt to the sheet), and hence the cohesive power between toners increases. With an increase in the cohesive power between toners, phenomena such as omission in the middle of character and omission of edge in a solid portion of the image are likely to occur. Since the resin belt has high hardness and does not deform according to the toner layer, it easily compresses the toner layer, and the phenomenon of omission in the middle of character is likely to occur.

Recently, there is a high demand to form a full color image on various types of paper, for example, Japanese paper and paper with intentional unevenness. However, with paper having poor smoothness, voids are easily generated between the paper and the toner at the time of transfer, and hence a defect of transferred colorant easily occurs. If the transfer pressure in the secondary transfer unit is increased to increase the adhesion, the cohesive power of the toner layer is increased, thereby causing omission in the middle of character.

On the other hand, the advantages in using the elastic belt are as follows. That is, the elastic belt deforms corresponding to the toner layer and the paper having poor smoothness in the transfer unit. In other words, since the elastic belt deforms, following to the local unevenness, favorable adhesion can be obtained without excessively increasing the transfer pressure with respect to the toner layer, and a transfer image having excellent uniformity with excellent adhesiveness and without omission in the middle of character can be obtained also with respect to the paper having poor smoothness.

However, it is difficult to suppress surface roughness of the elastic belt, due to the characteristic of the material, thereby causing a problem in that S/N in detection by a regular reflection component-detecting type sensor decreases.

SUMMARY OF THE INVENTION

It is an object of the present invention to solve at least the problems in the conventional technology.

The image forming apparatus according to one aspect of the present invention includes a reference-pattern detecting transfer-body to which a reference pattern image formed on an intermediate transfer body is transferred directly without a recording material, the reference-pattern detecting transfer-body arranged opposite to an intermediate transfer body in a secondary transfer unit in which images formed on a plurality of image carriers are transferred onto the intermediate transfer body, and an image formed on the intermediate transfer body is transferred onto the recording material; a reference-pattern detecting unit that detects the reference pattern transferred onto the reference-pattern detecting transfer-body; and a condition changing unit that changes conditions for forming an image based on a result of detection by the reference-pattern detecting unit.

The method of forming misalignment correction pattern according to another aspect of the present invention includes forming a correction target color pattern including a plurality of lines formed in a correction target color at a predetermined pitch on an intermediate transfer body; and forming a reference color pattern including a plurality of lines formed with a black toner at same pitch as the predetermined pitch, superposing on the correction target color pattern in such a manner that a patch of the reference color pattern and the correction target color pattern superposed is continuously arranged with respect to a reading direction of a sensor by shifting the reference color pattern by a predetermined distance from a position where the reference color pattern and the correction target color pattern are completely in an overlapped state to a position where the reference color pattern and the correction target color pattern are completely out of the overlapped state.

The apparatus for correcting a misalignment according to still another aspect of the present invention includes a pattern forming unit that forms a misalignment correction pattern on an intermediate transfer body, the misalignment correction pattern including a plurality of patches in which a reference color pattern at a reference position and a correction target color pattern formed in a correction target color are superposed; a sensor that optically reads the misalignment correction pattern formed; a detecting unit that detects a reflection component optically read by the sensor; a calculating unit that calculates an amount of misalignment of the correction target color with respect to the reference position based on a result of detection by the detecting unit; and a correcting unit that corrects the misalignment of the correction target color based on the amount of misalignment calculated.

The image forming apparatus according to still another aspect of the present invention includes an intermediate transfer body on which images formed on a plurality of image carriers are superposed and transferred; a pattern forming unit that forms a misalignment correction pattern including a plurality of patches in which a reference color pattern at a reference position and a correction target color pattern formed in a correction target color are superposed on the intermediate transfer body; a sensor that optically reads the misalignment correction pattern formed; a detecting unit that detects a reflection component optically read by the sensor; a calculating unit that calculates an amount of misalignment of the correction target color with respect to the reference position based on a result of detection by the detecting unit; a correcting unit that corrects the misalignment of the correction target color based on the amount of misalignment calculated; and an image forming unit that forms a color image at a position corrected.

The method of correcting misalignment according to still another aspect of the present invention includes forming a plurality of correction target color patterns in a correction target color on an intermediate transfer body, on which images formed on a plurality of image carriers are superposed and transferred, along the rotation direction of the intermediate transfer body; forming a plurality of reference color patterns at a reference position on the correction target color patterns and on the intermediate transfer body; detecting an amount of light reflected from the reference color patterns and the correction target color patterns using a sensor; calculating an amount of misalignment of the correction target color with respect to the reference position based on a result of the detecting; and correcting the misalignment of the correction target color based on the amount of misalignment calculated.

The computer program according to still another aspect of the present invention realizes the method of correcting a misalignment according to the above aspect on a computer.

The computer readable recording medium according to still another aspect of the present invention stores the computer program for correcting a misalignment according to the above aspect.

The other objects, features, and advantages of the present invention are specifically set forth in or will become apparent from the following detailed description of the invention when read in conjunction with the accompanying drawings.

DETAILED DESCRIPTION

Exemplary embodiments of an apparatus for detecting amount of toner deposit and controlling density of an image, method of forming misalignment correction pattern, and apparatus for detecting and correcting misalignment of an image according to the present invention are explained in detail with reference to the accompanying drawings. As a first embodiment of the present invention, one embodiment in which the present invention is applied to an electrophotographic copier (hereinafter, simply "copier"), being one example of the image forming apparatus, will be explained. The copier in this embodiment is a so-called tandem-type color copier including a photosensitive drum as an image carrier for each color, but the present invention is not limited thereto.

Figure 1:
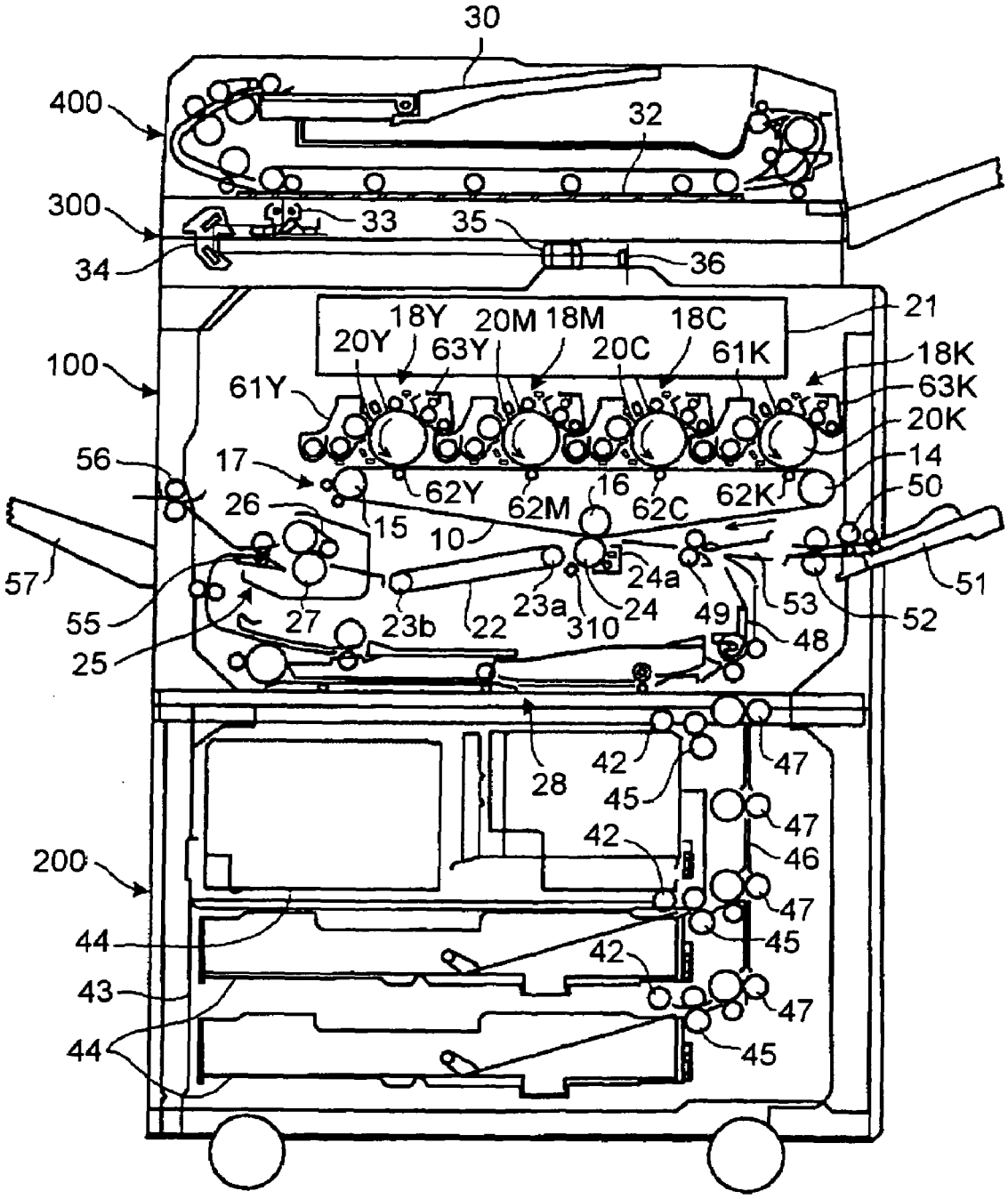
FIG. 1 is a schematic block diagram of a whole copier according to a first embodiment.

FIG. 1 is a schematic block diagram of the entire copier according to the first embodiment. This copier includes a copier main unit 100, a paper feed table 200 on which the copier main unit 100 is mounted, a scanner 300 fitted on the copier main unit, and an ADF 400 fitted to the upper part of the scanner.

Figure 2:
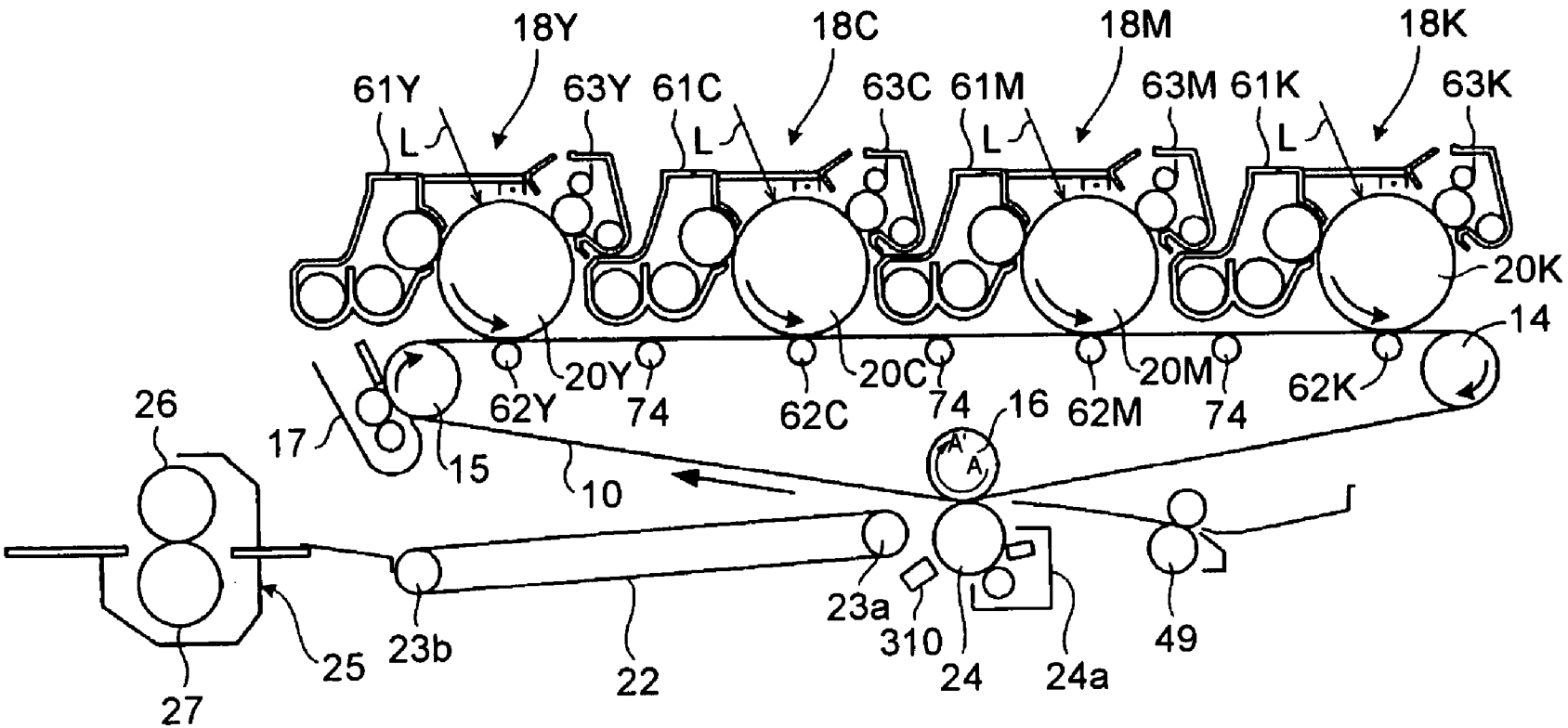
FIG. 2 is an enlarged diagram of the main configuration of a main unit part of the copier according to the first embodiment.
Figure 3:
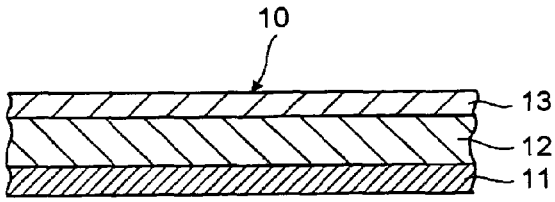
FIG. 3 is a partial sectional view of one example of the structure of an intermediate transfer belt.

FIG. 2 is an enlarged diagram of the main configuration of the copier main unit 100 of the copier shown in FIG. 1. In the copier main unit 100, a plurality of photosensitive drums 20Y, 20C, 20M, and 20K as image carriers, and an intermediate transfer belt 10 in an endless belt form as an intermediate transfer body, onto which images (for example, toner images) formed on the photosensitive drums 20Y, 20C, 20M, and 20K are superposed and transferred. The intermediate transfer belt 10 has, as shown in FIG. 3, a three-layer structure of a base layer 11, an elastic layer 12, and a coat layer 13. The base layer 11 is formed of, for example, a fluororesin having less elongation, or a material obtained by combining a rubber material having large elongation and a material, which is difficult to elongate, such as canvas, are combined. The elastic layer 12 is formed of, for example, fluorine rubber or acrylonitrile-butadiene copolymer rubber, and formed on the base layer 11. The coat layer 13 is formed, for example, by coating fluororesin on the surface of the elastic layer 12. The intermediate transfer belt 10 is rotated in the direction of from A to A' in FIG. 2, in the state of being laid across three support rollers 14, 15, and 16 in a tensioned condition.

Four image forming units 18Y, 18C, 18M, and 18K of yellow (Y), cyan (C), magenta (M), and black (K) are arrayed in a belt-laid portion between the first support roller 14 and the second support roller 15, of the three support rollers 14, 15, and 16. An exposure apparatus 21 is provided, as shown in FIG. 1, above these image forming units 18Y, 18C, 18M, and 18K.

As the exposure apparatus 21 are used, for example, a laser scanning type including optical systems such as a laser light source, a coupling lens, an optical deflector (rotary polygon mirror or the like), a scanning focusing lens, and a mirror, or an LED write type in which an LED array and an imaging optical system are combined. The exposure apparatus 21 is for forming an electrostatic latent image respectively on the photosensitive drums 20Y, 20C, 20M, and 20K provided in the respective image forming units as the image carriers, by irradiating writing beams L based on the image information on the original document read by the scanner 300. The third support roller 16 of the support rollers serves as a secondary transfer opposing member (a backup roller), and a secondary transfer roller 24 is provided at a position facing the third support roller (backup roller) 16. When a toner image on the intermediate transfer belt 10 is secondary-transferred onto a recording material (for example, recording paper), the secondary transfer roller 24 is pressed against the portion of the intermediate transfer belt 10 spanned over the third support roller (backup roller) 16 to perform secondary transfer. An endless carrier belt 22 is laid across between two rollers 23*a* and 23*b* in a tensioned condition, on the downstream side in the recording paper carrying direction by the secondary transfer roller 24 of the secondary transfer apparatus. On the further downstream side in the recording paper carrying direction, a fixing apparatus 25 is provided for fixing the toner image transferred on the recording paper. The fixing apparatus 25 has a configuration such that a pressure roller 27 is pressed against a heating roller 26 having a heat source. A belt cleaning apparatus 17 is provided at a position facing the second support roller 15, of the support rollers for the intermediate transfer belt 10. The belt cleaning apparatus 17 is for removing the residual toner remaining on the intermediate transfer belt 10, after having transferred the toner image on the intermediate transfer belt 10 onto the recording paper as the recording material.

The configuration of the image forming units 18Y, 18C, 18M, and 18K will be explained next. In the explanation below, the image forming unit 18K that forms a black toner image will be explained as an example, but other image forming units 18Y, 18C, and 18M have the similar configuration.

Figure 4:
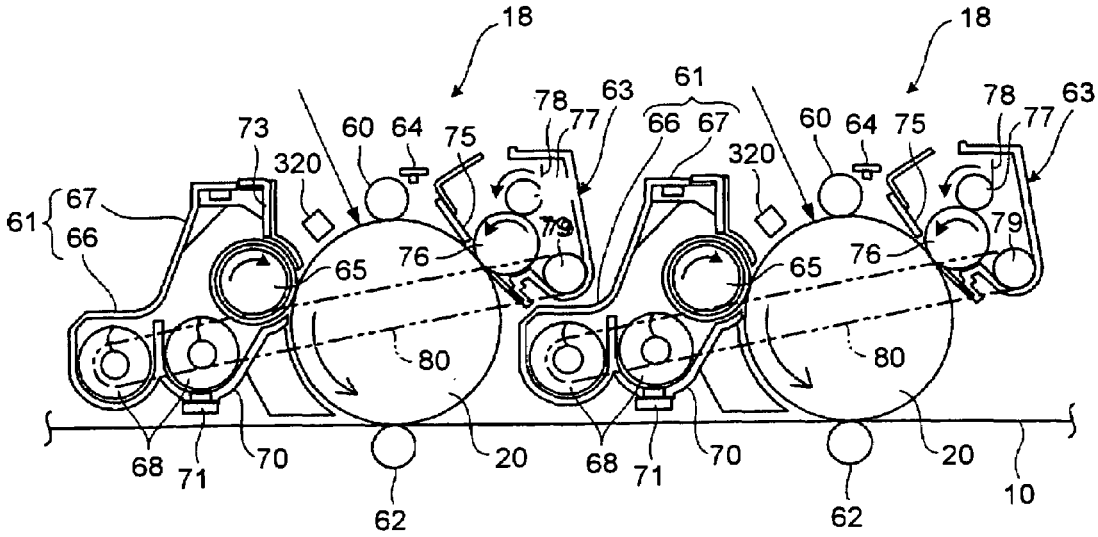
FIG. 4 is an enlarged diagram of a configuration example of two adjacent image forming units in the copier according to the first embodiment.

FIG. 4 is an enlarged diagram of the configuration of two adjacent image forming units 18M and 18K. In the reference signs in FIG. 4, "M" and "K" indicating the color are omitted, and those signs will be omitted appropriately in the explanation below.

A charging apparatus 60, a developing apparatus 61, and a photosensitive drum cleaning apparatus 63 are provided around the photosensitive drum 20 in the image forming unit 18. A primary transfer apparatus 62 is provided at a position facing the photosensitive drum 20, via the intermediate transfer belt 10.

The charging apparatus 60 is of a contact charging type adopting a charging roller, and uniformly charges the surface of the photosensitive drum 20 by coming in contact with the photosensitive drum 20 to apply voltage. For the charging apparatus 60, a charging brush or the like can be adopted instead of the charging roller, and a non-contact charging type adopting a non-contact Scorotron charger may be also used.

The developing apparatus 61 may use a one component developer including only the toner, but in this embodiment, a two component developer including a magnetic carrier and a nonmagnetic toner is used. The developing apparatus 61 can be largely divided into a stirring unit 66 and a developing unit 67. In the stirring unit 66, the two component developer (hereinafter, simply "developer") is carried while being stirred, and supplied to a developing sleeve 65 as a developer carrier. In the stirring unit 66 are provided two parallel screws 68, and between the two screws 68, a partition plate is provided for partitioning the space so that the opposite sides communicate with each other. A toner density sensor 71 for detecting the toner density of the developer in the developing apparatus is also fitted to a developing case 70. On the other hand, in the developing unit 67, the toner of the developer adhered on the developing sleeve 65 is transferred to the photosensitive drum 20. The developing sleeve 65 facing the photosensitive drum 20 is provided in the developing unit 67 via an opening of the developing case 70, and a magnet (not shown) is fixed and arranged in the developing sleeve 65. A doctor blade 73 is also provided so that the point thereof is brought into contact with the developing sleeve 65. In this embodiment, the gap between the doctor blade 73 and the developing sleeve 65 at the closest point is set to be 0.9 millimeter.

In the developing apparatus 61, the developer is carried and circulated while being stirred by the two screws 68, and supplied to the developing sleeve 65. The developer supplied to the developing sleeve 65 is drawn up and held by the magnet. The developer drawn up to the developing sleeve 65 is carried with the rotation of the developing sleeve 65, and controlled to an adequate amount by the doctor blade 73. The controlled developer is returned to the stirring unit 66. The developer carried to the developing zone opposite to the photosensitive drum 20 becomes clustered by the magnet, thereby forming a magnetic brush. In the developing zone, a development field that shifts the toner in the developer to the electrostatic latent image portion on the photosensitive drum 20 is formed by the developing bias applied to the developing sleeve 65. As a result, the toner in the developer is transferred to the electrostatic latent image portion on the photosensitive drum 20, and the electrostatic latent image on the photosensitive drum 20 is visualized to form a toner image. The developer having passed through the developing zone is carried to a portion where the magnetic force of the magnet is weak, where the developer comes off from the developing sleeve 65, and is returned to the stirring unit 66. Due to repetition of such an operation, when the toner density in the stirring unit 66 becomes thin, the toner density sensor 71 detects this state, and the toner is supplied from a toner supply unit (not shown) to the stirring unit 66, based on the detection result.

A primary transfer roller is adopted for the primary transfer apparatus 62, and is arranged so that it is pressed against the photosensitive drum 20, putting the intermediate transfer belt 10 therebetween. The primary transfer apparatus 62 may be an electrically conductive brush or a non-contact corona charger, instead of the roller.

The photosensitive drum cleaning apparatus 63 includes a cleaning blade 75, for example, made of polyurethane rubber, which is arranged with the point thereof pressed against the photosensitive drum 20. In this embodiment, an electrically conductive fur brush 76 is also used, which comes in contact with the photosensitive drum 20, in order to increase the cleaning performance. A bias is applied to the fur brush 76 from a metal electric field roller 77, and a point of a scraper 78 is pressed against the electric field roller 77. The toner removed from the photosensitive drum 20 by the cleaning blade 75 and the fur brush 76 is stored in the photosensitive drum cleaning apparatus 63. Thereafter, the stored toner is drawn to one side of the photosensitive drum cleaning apparatus 63 by a collection screw 79, returned to the developing apparatus 61 through a toner recycle apparatus 80 described later, and reused.

A discharging apparatus 64 includes a discharging lamp, and irradiates light to initialize the surface potential of the photosensitive drum 20.

The specific setting in the embodiment will be explained here. The diameter of the photosensitive drum 20 is 60 millimeters, and the photosensitive drum 20 is driven at a linear velocity of 282 mm/s. The diameter of the developing sleeve 65 is 25 millimeters, and the developing sleeve 65 is driven at a linear velocity of 564 mm/s. The charged amount of the toner in the developer supplied to the developing zone is preferably in a range of about from −10 μC/g to −30 μC/g. The development gap, being a gap between the photosensitive drum 20 and the developing sleeve 65, can be set in a range of from 0.5 millimeter to 0.3 millimeter, and the development efficiency can be improved by reducing this value. The thickness of the photosensitive layer on the photosensitive drum 20 micrometers is 30 micrometers, the beam spot diameter of the optical system in the exposure apparatus 21 is 50×60 micrometers, and the quantity of light thereof is about 0.47 milliwatt. As one example, the surface of the photosensitive drum 20 is uniformly charged to −700 volts by the charging apparatus 60, and the potential in the electrostatic latent image portion, to which laser beams are irradiated by the exposure apparatus 21, becomes −120 volts. On the other hand, the voltage of the development bias is set to −470 volts, to ensure the development potential of 350 volts. Such process conditions are changed at the right time according to the result of the process control described later.

In the image forming unit 18 having such a configuration, the surface of the photosensitive drum 20 is uniformly charged by the charging apparatus 60, with a rotation of the photosensitive drum 20. Writing beams L by a laser or an LED are then irradiated from the exposure apparatus 21, based on the image information read by the scanner 300, to form an electrostatic latent image on the photosensitive drum 20. Thereafter, the electrostatic latent image is visualized by the developing apparatus 61, to form a toner image. This toner image is primary transferred onto the intermediate transfer belt 10 by the primary transfer apparatus 62. Residual toner remaining on the surface of the photosensitive drum 20 after the primary transfer is removed by the photosensitive drum cleaning apparatus 63, and the surface of the photosensitive drum 20 is discharged by the discharging apparatus 64 for the next image formation.

Figure 6:
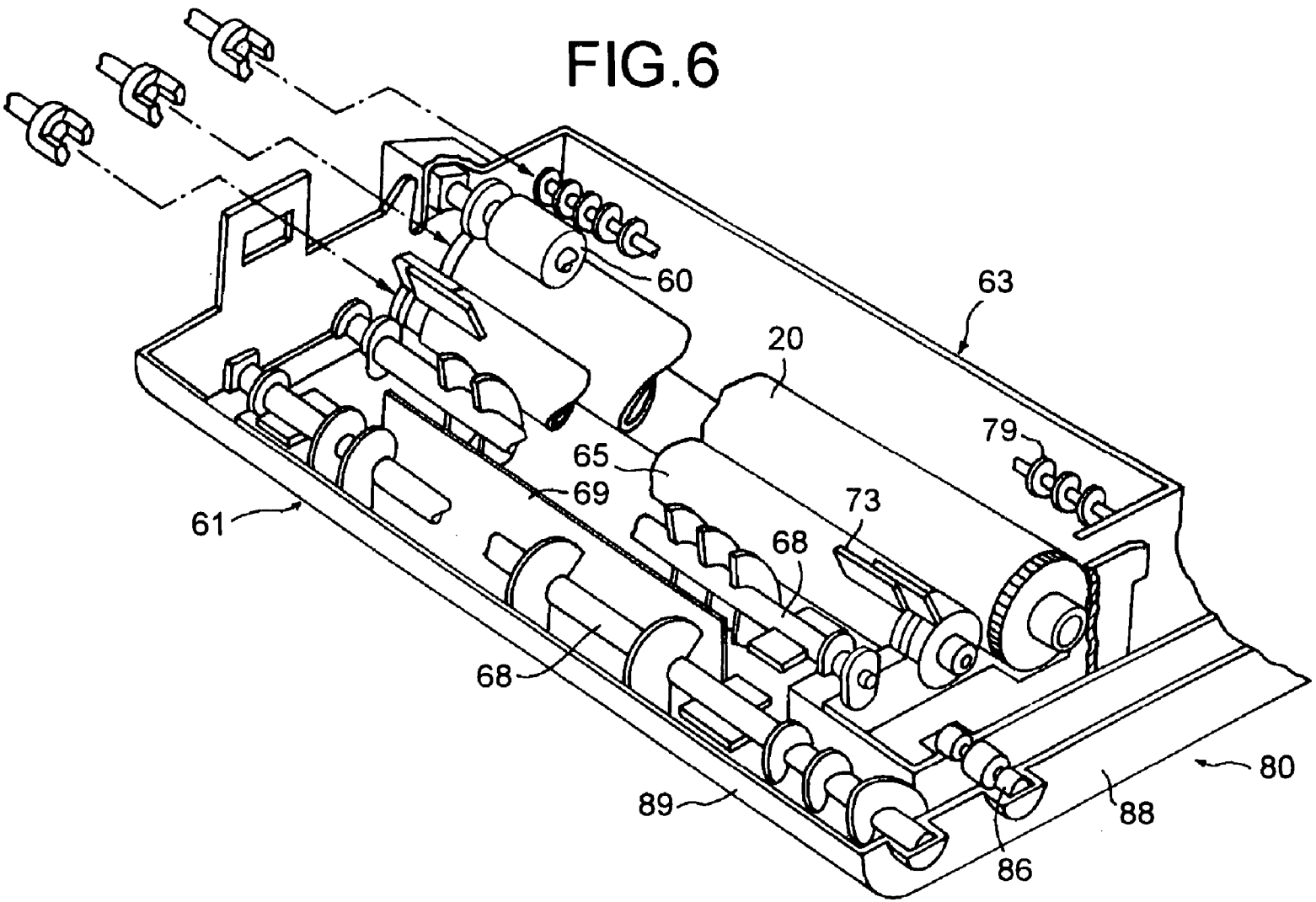
FIG. 6 is a diagram of the schematic configuration of a toner recycle apparatus in the copier according to the first embodiment.
Figure 7:
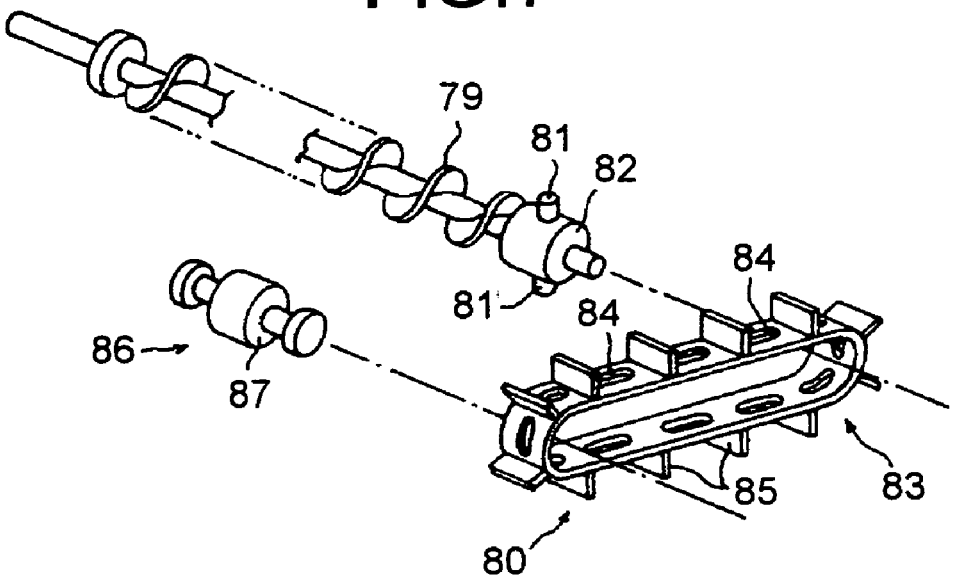
FIG. 7 is an enlarged diagram of one end portion of a collection screw of a photosensitive drum cleaning apparatus in the copier according to the first embodiment.

FIG. 6 depicts the schematic configuration of the toner recycle apparatus 80. FIG. 7 is an enlarged diagram of one end portion of the collection screw in the photosensitive drum cleaning apparatus 63.

As shown in FIG. 7, the toner recycle apparatus 80 includes a roller unit 82 provided at one end of the collection screw 79 in the photosensitive drum cleaning apparatus 63. A pin 81 is provided in the roller unit 82. A belt-like collected toner carrying member 83 is laid across between the roller unit 82 and a roller unit 87 of a rotation shaft 86 in a tensioned state. At this time, the pin 81 in the roller unit 82 becomes a state in which the pin 81 gets into a long hole 84 provided in the collected toner carrying member 83. Vanes 85 are provided at a predetermined interval on the outer circumference of the collected toner carrying member 83. The collected toner carrying member 83 is, as shown in FIG. 6, housed in a carrier path case 88 together with the rotation shaft 86. This carrier path case 88 is integrally formed with a cartridge case 89 that integrally houses at least a part of the components of the image forming unit 18. Inside the carrier path case 88, one of the two screws 68 protrudes from the developing apparatus 61.

In such a configuration, a driving force is transmitted from outside to rotate the collection screw 79 and the collected toner carrying member 83. As a result, the toner collected by the photosensitive drum cleaning apparatus 63 is carried to the developing apparatus 61 through the carrier path case 88, and stored in the developing apparatus 61 by the screw 68. Thereafter, the collected toner is stirred and circulated together with the developer in the developing apparatus 61 by the two screws 68, thereby contributing the development again.

When an original document is copied by using the copier having the above configuration, at first, the document is set on an original table 30 in the ADF 400, or the ADF 400 is opened to set the document on a contact glass 32 of the scanner 300, and the ADF 400 is closed to hold the document. Thereafter, when a user pushes a start switch (not shown), the document is carried onto the contact glass 32, when the document is set on the ADF 400. The scanner 300 is driven so that a first traveling body 33 and a second traveling body 34 start to travel. As a result, the light from the first traveling body 33 is reflected by the document on the contact glass 32, and the reflected light is reflected again by a mirror in the second traveling body 34, and guided to an image reading sensor 36 such as a CCD through a focusing lens 35. In this manner, the image information on the document is read.

When the user pushes the start switch, a drive motor (not shown) is driven, and one of the support rollers 14, 15, and 16 is rotated to rotate the intermediate transfer belt 10. At the same time, the photosensitive drums 20Y, 20C, 20M, and 20K in the respective image forming units 18Y, 18C, 18M, and 18K also rotate. The writing beams L are respectively irradiated onto the photosensitive drums 20Y, 20C, 20M, and 20K in the respective image forming units 18Y, 18C, 18M, and 18K from the exposure apparatus 21, based on the image information read by the image reading sensor 36 of the scanner 300. As a result, the electrostatic latent image is respectively formed on the photosensitive drums 20Y, 20C, 20M, and 20K, and visualized by the developing apparatus 61Y, 61C, 61M, and 61K, and the toner images of yellow, cyan, magenta, and black are respectively formed on the respective photosensitive drums 20Y, 20C, 20M, and 20K. The respective color toner images formed in this manner are primary transferred onto the intermediate transfer belt 10 sequentially so as to be superposed on each other. As a result, a composite toner image in which the respective color toner images are superposed on each other is formed on the intermediate transfer belt 10 by the respective primary transfer apparatus 62Y, 62C, 62M, and 62K. The residual toner remaining on the intermediate transfer belt 10 after the secondary transfer is removed by the belt cleaning apparatus 17.

When the user pushes the start switch, a paper feed roller 42 in the paper feed cassette 44 of a multi-stage paper feeder 43 in the paper feed table 200, corresponding to the recording paper selected by the user, rotates to feed the recording paper from one of the paper feed cassettes 44. The fed recording paper is separated one by one by a separating roller pair 45, goes into a paper feed path 46, and is carried to a paper feed path 48 in the copier body 100 by carrier roller pairs 47. The recording paper carried in this manner is stopped when abutting against a resist roller pair 49. When recording paper, which is not set in the paper feed cassette 44 in the multi-stage paper feeder 43, is to be used, the recording paper set on a manual feed tray 51 is sent out by a paper feed roller 50, and after separated one by one by a separating roller pair 52, the recording paper is carried through a manual paper feed path 53. The recording paper carried in this manner is also stopped when abutting against the resist roller pair 49.

The resist roller 49 starts rotation at a timing at which the composite toner image formed on the intermediate transfer belt 10 is carried to the secondary transfer unit opposite to the secondary transfer roller 24 in the secondary transfer apparatus. The resist roller 49 is often grounded and used, but a bias may be applied in order to remove paper dust of the recording paper. The recording paper fed out by the resist roller 49 is sent to the space between the intermediate transfer belt 10 and the secondary transfer roller 24, and the secondary transfer apparatus secondary-transfers the composite toner image on the intermediate transfer belt 10 onto the recording paper.

Figure 5:
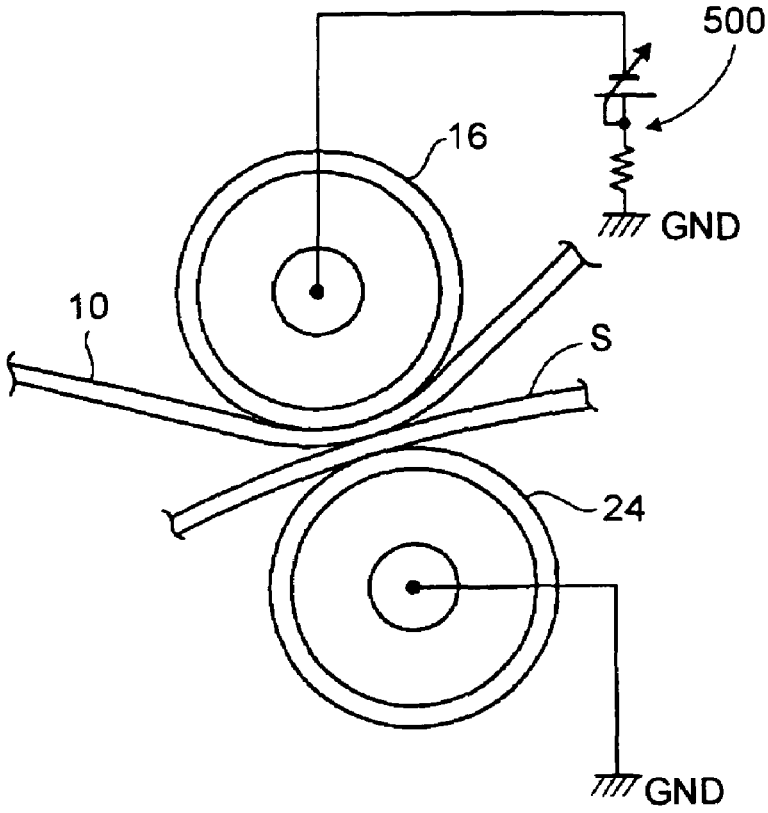
FIG. 5 is an enlarged diagram of the main part of a configuration example of a secondary transfer unit in the copier according to the first embodiment.

More specifically, as shown in FIG. 5, the backup roller (the third support roller) 16 is arranged on the backside of the intermediate transfer belt 10 at the secondary transfer position, as the secondary transfer opposing member, which is facing the secondary transfer roller 24, putting the intermediate transfer belt 10 therebetween. When a transfer bias (repulsive bias) of the same polarity as the charging polarity of the toner constituting the toner image is applied to the backup roller 16 by a voltage bias applying unit 500 connected to the backup roller 16, a transfer field is formed between the grounded secondary transfer roller 24 and the backup roller 16. The unfixed toner image carried on the intermediate transfer belt 10 is electrostatically transferred onto the recording paper S at the secondary transfer position, thereby performing the secondary transfer. Thereafter, the recording paper S is moved from the secondary transfer roller 24 to the carrier belt 22, and carried to the fixing apparatus 25, with the paper attracted to the carrier belt 22. Heat and pressure are then applied thereto by the fixing apparatus 25, to perform the fixing processing of the toner image. The recording paper having passed through the fixing apparatus 25 is ejected to a paper ejection tray 57 by ejection rollers 56, and stacked therein. When image formation is to be performed also on the backside of the paper where the toner image has been fixed, the carrier path of the recording paper having passed through the fixing apparatus 25 is switched over by a switching claw 55. The recording paper is sent to a sheet reversing unit 28 located below the secondary transfer apparatus, and reversed and guided again to the secondary transfer unit. The voltage bias applying unit 500 constitutes the bias applying unit of the present invention.

Figure 8:
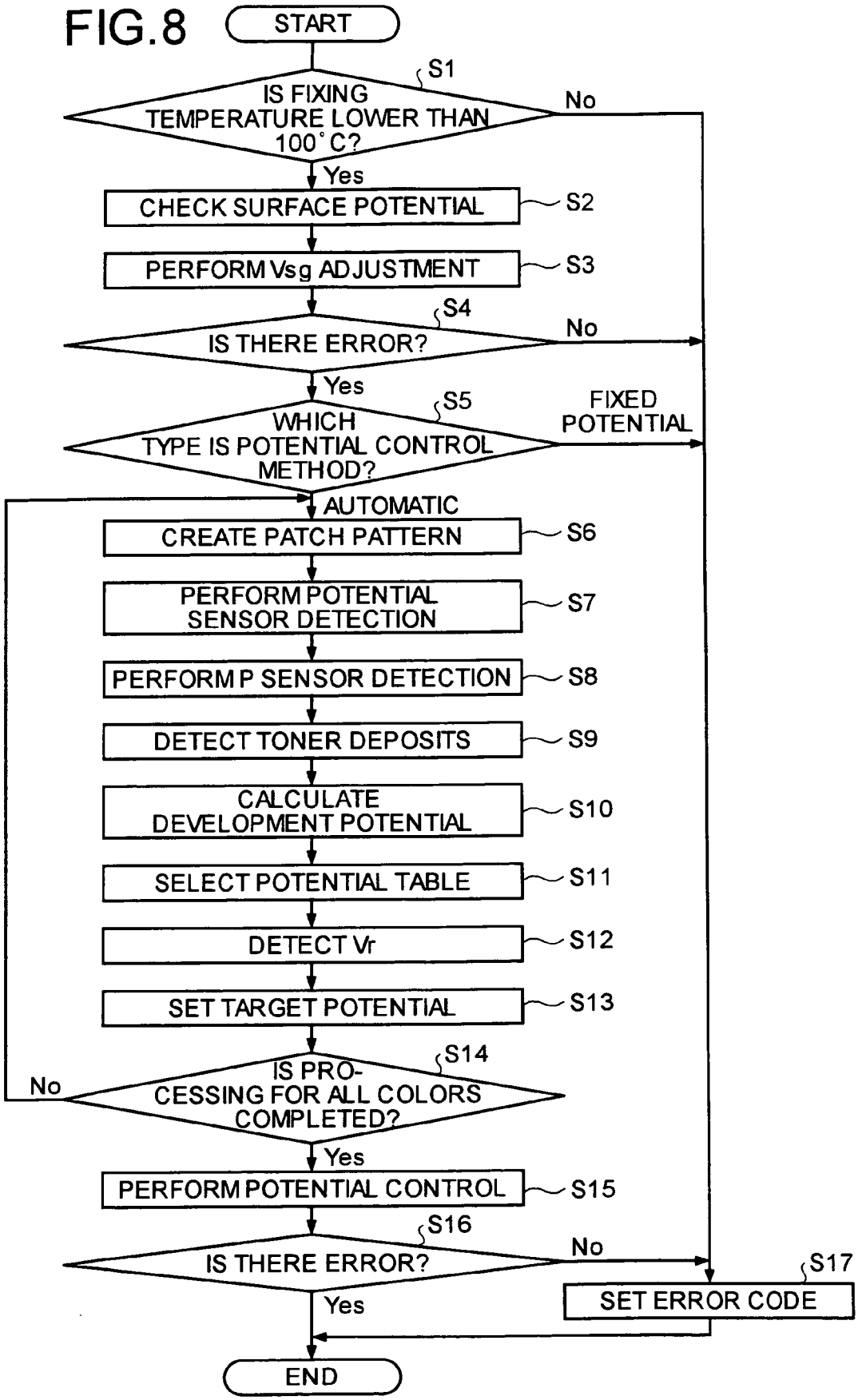
FIG. 8 is a flowchart of a potential control routine in a main controller of the copier according to the first embodiment.
Figure 9:
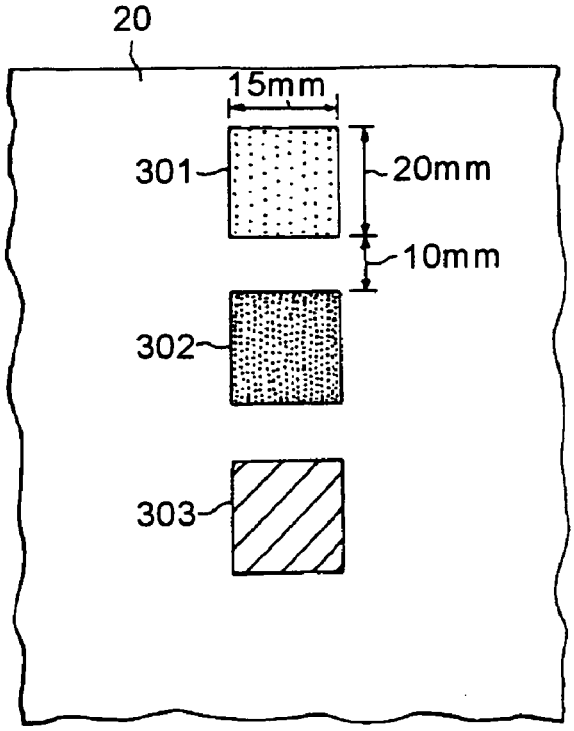
FIG. 9 is a diagram for explaining a patch pattern formed on a photosensitive drum in the copier according to the first embodiment.
Figure 10:
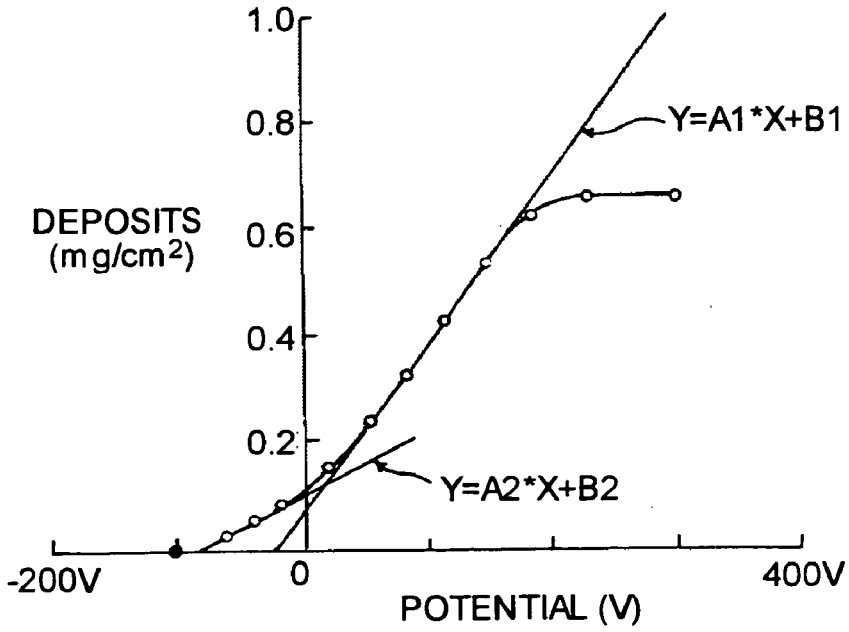
FIG. 10 depicts the relation between potential data at the time of controlling the potential of the copier according to the first embodiment and toner deposit data in respective latent image patterns.
Figures 11, 12:
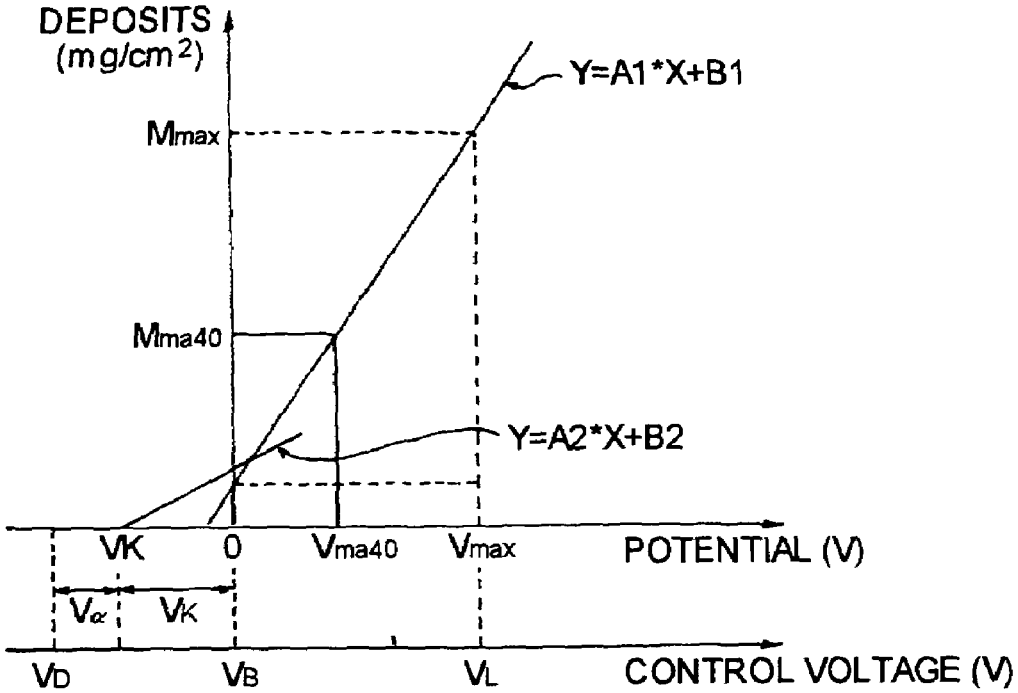
FIG. 11 depicts collinear approximation between potential data and control potential data, with respect to the toner deposit data at the time of controlling the potential of the copier according to the first embodiment.
FIG. 12 depicts one example of a potential control table at the time of controlling the potential of the copier according to the first embodiment.

The potential control by a main controller (not shown) including a central processing unit (CPU), memories (ROM, RAM), various control circuits, a clock, a timer, a counter, and input and output units will be explained, with reference to FIGS. 8 to 12. FIG. 8 is a flowchart of the potential control routine in the main controller; FIG. 9 is a diagram for explaining a patch pattern formed on the photosensitive drum; FIG. 10 is a graph of the relation between potential data at the time of controlling the potential and toner deposit data in respective latent image patterns; FIG. 11 is a graph of collinear approximation between the potential data and control potential data, with respect to the toner deposit data at the time of controlling the potential; and FIG. 12 depicts a potential control table at the time of controlling the potential. The CPU uses the RAM as a work area to execute the processing according to a program stored in the ROM (not shown). The ROM stores the program executed by the CPU, and static information to be used by the CPU, and the RAM serves as the work area for the CPU, and stores dynamic information used by the CPU to execute the processing. The main controller constitutes a condition changing unit of the present invention. Further, the main controller and the optical reflection density detecting unit constitute a reference-pattern detecting unit of the present invention.

The routine in the potential control shown in FIG. 8 is executed basically at the time of startup of the apparatus, and as required, such as every time when a predetermined number of copies are made, or at predetermined time intervals. The execution operation at the time of early startup will be explained below. At first, in order to differentiate the state at the time of power on from the state at the time of abnormal processing such as jamming, at step S1, the fixing temperature of the fixing apparatus 25 is detected as the execution condition of potential control. It is determined whether the fixing temperature of the fixing apparatus 25 exceeds 100° C., based on an input signal from a fixing temperature sensor, and when the fixing temperature of the fixing apparatus 25 exceeds 100° C., it is determined to be abnormal, and potential control is not executed.

Figure 13:
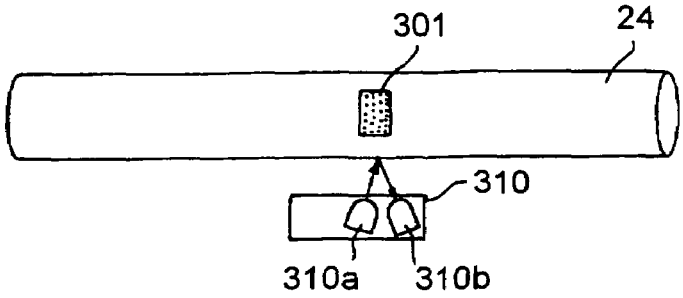
FIG. 13 depicts one example of the construction of configuration of a reflection density sensor with respect to a secondary transfer roller.

When the fixing temperature of the fixing apparatus 25 does not exceed 100° C., control proceeds to step S2, and a surface potential sensor 320 shown in FIG. 4 checks the surface potential of the photosensitive drum 20 uniformly charged under predetermined conditions, and when the surface potential is not within a predetermined range, the surface potential sensor 320 notifies the system of the abnormal surface potential. At step S3, Vsg adjustment is performed. In this Vsg adjustment, as shown in FIG. 13, light is irradiated from an LED 310*a* in a reflection density sensor 310 formed of an infrared ray reflection type sensor, being the optical reflection density detecting unit, to the secondary transfer roller 24, and the reflected light from the secondary transfer roller 24 is received by a photodetector 310*b*, and an output value with respect to the background of the secondary transfer roller 24 is taken in. The light emitting amount of the LED 310*a* in the reflection density sensor 310 is then adjusted so that the reflected light of the light irradiated from the reflection density sensor 310 to the background of the secondary transfer roller 24 becomes a certain value.

At step S4, it is checked whether there is no abnormal situation at steps S2 and S3. When there is an abnormal situation, control proceeds to step S17. At step S5, it is determined whether the potential control method is set to automatic setting or fixed setting. At steps S3 and S4, the operation is performed prior to step S6, in order to use the data in other toner supply control and the like, regardless of the potential control method. When the potential control method is fixed at step S5, an error code is set at step S17 to finish the self-check. When the potential control method is automatic, the operation at steps S6 and S7 is performed.

At step S6, a patch pattern, being a latent image pattern, is formed on the photosensitive drum 20. The latent image pattern is formed for each color, that is, at four places shifted from each other, with respect to the width direction of the photosensitive drum 20, as shown in FIG. 9, so as to form electrostatic latent images (N electrostatic latent image patterns) 301, 302, 303, . . . having N tone densities at a predetermined interval, along the rotation direction of the photosensitive drum 20. In this embodiment, latent image patterns 301, 302, 303, . . . , which are respectively rectangular of 15×20 millimeters, having 16 different tone densities, are formed at an interval of 10 millimeters with respect to the rotation direction of the photosensitive drums 20.

At next step S7, the output values of the surface potential sensor 320 with respect to the potentials of the latent image patterns 301, 302, 303, . . . are read and stored in the RAM (not shown) connected to the main controller. For example, 16 latent image patterns 301, 302, 303, . . . of yellow (Y) are formed on the photosensitive drums 20 at a predetermined interval, and the latent image patterns on the photosensitive drum is turned into a manifest image with the toner in the developing apparatus. The thus formed toner images (reference patterns) on the photosensitive drum are primary transferred to the intermediate transfer belt 10 by the primary transfer apparatus 62Y, and then transferred to the secondary transfer roller 24. At this time, the secondary transfer roller 24 serves as a reference-pattern detecting transfer-body. The position of the reflection density sensor 310 with respect to the reference patterns 301, 302, 303, . . . transferred to the secondary transfer roller 24 is as shown in FIG. 13.

The main controller then performs pattern sensor detection (hereinafter, P sensor detection) at step S8. In this P sensor detection, Y latent image patterns 301, 302, 303, . . . on the photosensitive drums 20 are developed by the yellow developing apparatus 20Y to turn the patterns into manifest images to obtain the toner images (reference patterns), and the toner images are transferred to the secondary transfer roller 24 as the reference-pattern detecting transfer-body, and the output values of the reflection density sensor 310 with respect to the toner images are stored in the RAM as Vpi (i=1 to N) for each color.

The main controller then calculates the amount of toner deposits at step S9. In other words, the output values of the reflection density sensor 310 stored in the RAM are converted to the amount of toner deposits per unit area by referring to the table stored beforehand in the ROM (not shown) connected to the main controller, and stored again in the RAM. Steps S10 to S12 are then executed. These steps will now be explained in detail.

FIG. 10 is a graph in which the relation in the respective latent image patterns between the potential data obtained at step S7 and the toner deposit data obtained at steps S8 and S9 are plotted on the X-Y plane. The X axis indicates the potential (a difference between the developing bias $V_B$ and the surface potential of the photosensitive drum 20) (unit: V), and the Y axis indicates the amount of toner deposits per unit area (mg/cm$^2$). In this embodiment, the reflection density sensor 310 is formed of an optical sensor, such as the infrared ray reflection type sensor, and the infrared ray reflection type sensor generally indicates a saturation characteristic, as shown in FIG. 10, in the part where the amount of toner deposits is large, and hence the obtained detection value does not correspond to the actual amount of toner deposits. Therefore, if the detection value of the reflection density sensor 310 obtained in the part where the amount of toner deposits is large is directly used to calculate the amount of toner deposits, the amount of toner deposits different from the actual amount of toner deposits is obtained, and hence the toner supply control to be performed based on the amount of toner deposits cannot be performed accurately. Therefore, the main controller in this embodiment selects the potential of the latent image pattern obtained from the surface potential sensor 320 and the reflection density sensor 310 and the toner deposit data after obtaining the manifest image, only in the straight section in the relation between the potential data Xn (n=1 to 10) and the toner deposit data Yn (the development Y characteristic of the developing apparatus), for each latent image pattern of each color. By applying the method of least squares with respect to the data in this section, the collinear approximation of the developing characteristics of the respective developing apparatus is performed by a method described later, to obtain an approximate linear equation (E) of the development characteristics for each color, and the control potential is calculated for each color by this approximate linear equation (E).

For the calculation according to the method of least squares, the following equations are used.

$$Xave=\Sigma Xn/k \quad (1)$$

$$Yave=\Sigma Xn/k \quad (2)$$

$$Sx=\Sigma(Xn-Xave)\times(Xn-Xave) \quad (3)$$

$$Sy=\Sigma(Yn-Yave)\times(Yn-Yave) \quad (4)$$

$$Sxy=\Sigma(Xn-Xave)\times(Yn-Yave) \quad (5)$$

When the approximate linear equation (E) obtained from the potential of the latent image pattern obtained from the surface potential sensor 320 and the reflection density sensor 310, and data of the toner deposit amount after obtaining the manifest image is as follows $$X=A1\times X+B1$$

by using the above variables, coefficients A1 and B1 can be expressed as $$A1=Sxy/Sx \quad (6)$$

$$B1=Yave-A1\times Xave \quad (7)$$

Further, the correlation coefficient R of the approximate linear equation (E) is expressed as $$R\times R=(Sxy\times Sxy)/(Sx\times Sy) \quad (8)$$

In the embodiment, at step S9, the main controller takes out six data sets (X1 to X5, Y1 to Y5)
(X2 to X6, Y2 to Y6)
(X3 to X7, Y3 to Y7)
(X4 to X8, Y4 to Y8)
(X5 to X9, Y5 to Y9)
(X6 to X10, Y6 to Y10)

from the data having a smaller numerical value of the potential data Xn of the latent image pattern obtained from the surface potential sensor 320 and the reflection density sensor 310, and the data Yn of toner deposits after obtaining the manifest image, to perform calculation of collinear approximation according to the equations (1) to (8), and the correlation coefficient R is also calculated, to obtain the following six sets of approximate linear equation and correlation coefficient (9) to (14)

$$Y11=A11\times X+B11;R11 \quad (9)$$

$$Y12=A12\times X+B12;R12 \quad (10)$$

$$Y13=A13\times X+B13;R13 \quad (11)$$

$$Y14=A14\times X+B14;R14 \quad (12)$$

$$Y15=A15\times X+B15;R15 \quad (13)$$

$$Y16=A16\times X+B16;R16 \quad (14)$$

The main controller selects one set of approximate linear equation corresponding to the largest value in the correlation coefficients R11 to R16, from the obtained six sets of approximate linear equation, as the approximate linear equation (E).

At step S10, the main controller calculates X when Y becomes the necessity maximum toner deposits Mmax, that is, the development potential Vmax, as shown in FIG. 11, in the selected approximate linear equation (E) for each color. The development bias potential $V_B$ of the yellow developing apparatus 20Y and the surface potential (exposure potential) $V_L$ by the yellow image exposure on the photosensitive drum 20 are provided from equations (15) and (16).

$$V\max=(M\max-B1)/A1 \quad (15)$$

$$V_B-V_L=V\max=(M\max-B1)/A1 \quad (16)$$

The relation between $V_B$ and $V_L$ can be expressed by using the coefficient of the approximate linear equation (E). Therefore, the equation (16) becomes as follows $$M\max=A1\times V\max+B1 \quad (17)$$

The relation between the charging potential $V_D$ before exposure of the photosensitive drum 20 and the development bias potential $V_B$ is provided from the linear equation as shown in FIG. 11, that is, by the following equation (19)

$$Y=A2\times X+B2 \quad (18)$$

from X coordinate VK (development start voltage Vk) at an intersection of $$V_D-V_B=Vk+Va \quad (19)$$

and the X axis, and a greasing margin voltage Va.

Therefore, the relations between Vmax and $V_D$, $V_B$, and $V_L$ are determined by the equations (16) and (19). In this example, Vmax is designated as a reference value, and the relations between the respective control voltages $V_D$, $V_B$, and $V_L$ and Vmax are determined beforehand by experiments or the like, and put into a table as shown in FIG. 12 and stored in the ROM. At step S11, the main controller selects a table having Vmax closest to the calculated Vmax for each color, and designates respective control voltages $V_D$, $V_B$, and $V_L$ corresponding to the selected table as target potentials.

At step S12, the main controller controls the laser emission power of a semiconductor laser (not shown) so as to become the maximum quantity of light, for example, via a laser emission drive controller in the exposure apparatus 21, and takes in the output value of the surface potential sensor 320 to detect the residual potential on the photosensitive drum 20. At step S13, when the residual potential is not 0, correction for the residual potential is performed with respect to the target potentials $V_D$, $V_B$, and $V_L$ determined by the table, to set the target potentials.

At step S14, the processing is branched until the operation at steps S6 to S13 sequentially finishes for each color of Y, C, M, and K, and when processing for all colors has finished, control proceeds to potential control at step S15.

At step S15, the power source circuit is adjusted so that the charging potential of the photosensitive drum 20 by the charging roller 60 becomes the target potential $V_D$, in parallel for the respective colors, and the laser emission power in the laser optical system is adjusted via a laser optical system controller so that the exposure potential of the photosensitive drum 20 becomes the target potential $V_L$. Further, the power source circuit is adjusted so that the respective developing bias voltages of the black developing apparatus 20K, the cyan developing apparatus 20C, the magenta developing apparatus 20M, and the yellow developing apparatus 20Y respectively become target potential VB.

At step S16, it is determined whether there is no error at steps S6 to S15. If there is an error in one color, even if only other colors are controlled, the image density largely changes. Therefore, an error code is set to finish the processing. In this case, the imaging conditions are not updated, and imaging is performed under the same imaging conditions as before until the next self-check is successful.

Such potential control is important particularly in the color image forming apparatus, in order to maintain the image quality constant.

In this embodiment, the special jobs described above are executed when any one of conditions a to c below is satisfied, and the content thereof is the same as the self-check described above:

a. at the time of power on, when the fixing temperature is equal to or below a predetermined temperature;
b. when a predetermined number of images is formed after the previous self-check (potential control); and
c. when predetermined time has passed since the previous self-check (potential control).

In the embodiment, the size of the reflection density sensor 310 is made small in order to arrange the reflection density sensor 310 in the image forming apparatus in the tandem system. It is important for the downsizing how much the components in the photodetector and the LED can be made small. Generally, with downsizing of the photodetector and the LED, the emission intensity and the photodetecting sensitivity (S/N ratio) decrease. In the embodiment, therefore, the gloss level (GS) of the secondary transfer roller 24, being the reference-pattern detecting transfer-body, in the surface axial direction is set to GS>60.

In the embodiment, an A/D converter having a sampling cycle of 4 microseconds independent for each channel is adopted, in order to process the output from the surface potential sensor 320 and the reflection density sensor 310 at a high speed for the respective four colors.

A second embodiment of the present invention will be explained next. The basic configuration of the image forming apparatus (copier) is the same as in the first embodiment.

Figure 16:
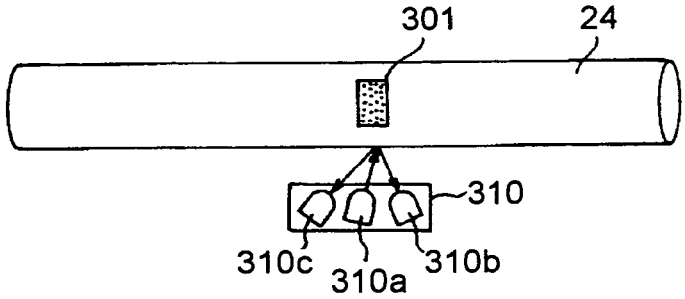
FIG. 16 depicts an example of the construction of configuration of a reflection density sensor with respect to a secondary transfer roller.

In the second embodiment, the reflection density sensor 310 in the image forming apparatus in the first embodiment is a near infrared regular reflection+diffuse reflection sensor including one LED 310*a* and two photodetectors 310*b* and 310*c*, as shown in FIG. 16.

Figure 14:
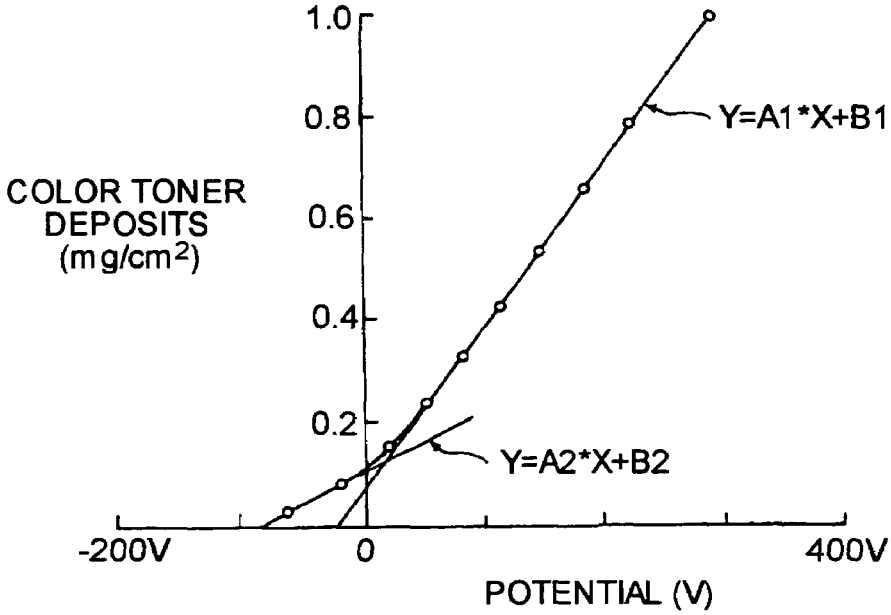
FIG. 14 depicts the relation between the potential and the amount of color toner deposits.
Figure 15:
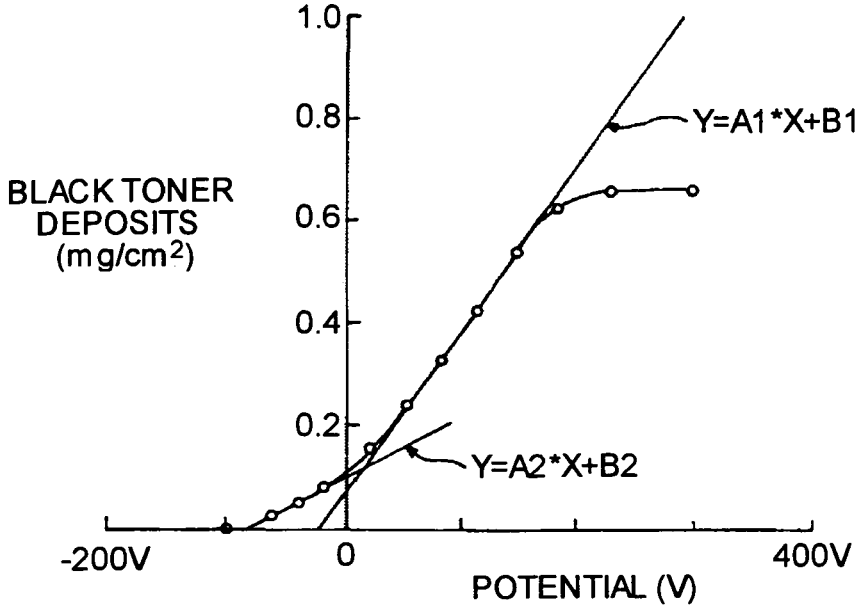
FIG. 15 depicts the relation between the potential and the amount of black toner deposits.

FIGS. 14 and 15 are graphs in which the relation in the respective latent image patterns between the potential data obtained at step S7 and the toner deposit data obtained at steps S8 and S9 in FIG. 8 are plotted on the X-Y plane. The X axis indicates the potential (a difference between the developing bias $V_B$ and the surface potential of the photosensitive drum 20) (unit: V), and the Y axis indicates the amount of toner deposits per unit area (mg/cm$^2$) of color toners (FIG. 14) and the black toner (FIG. 15). In this embodiment, the reflection density sensor 310 is formed of an optical sensor such as the near infrared regular reflection+diffuse reflection sensor, and the infrared diffuse reflection type sensor generally shows such a characteristic that it does not saturate even in a part where the amount of color toner deposits is large, as shown in FIG. 14. However, since the infrared emission is absorbed by the black toner, the black toner has a characteristic as shown in FIG. 15.

In this embodiment, therefore, regular reflection detection is used for detecting the density of the black toner and adjusting the emission amount with respect to the background, and the diffuse reflection detection is used for detecting the density of the color toners.

Figure 17:
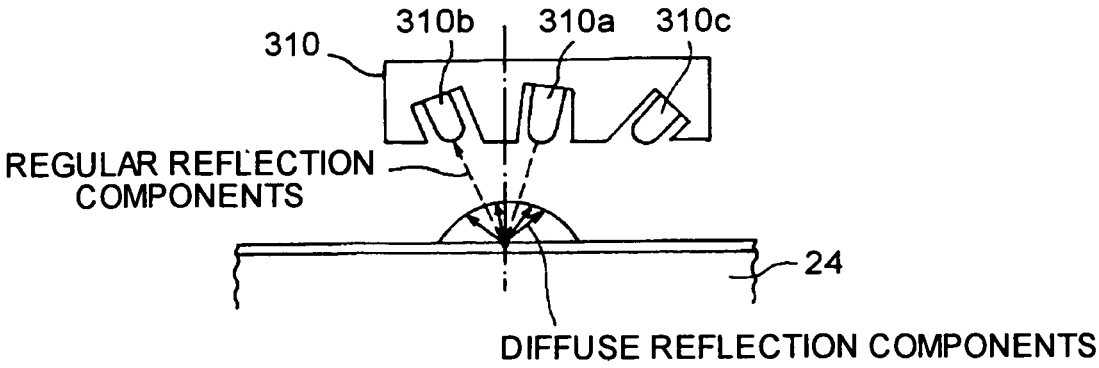
FIG. 17 depicts a representative example of reflection components of the secondary transfer roller with respect to the reflection density sensor.

FIG. 16 depicts an example of the construction of configuration of the secondary transfer roller 24, being the reference-pattern detecting transfer-body, and the reflection density sensor 310, and FIG. 17 depicts a representative example of reflection components of the secondary transfer roller 24 with respect to the reflection density sensor 310. The reflection density sensor 310 as shown in FIGS. 16 and 17 includes one LED 310*a* and two photodetectors 310*b* and 310*c*, wherein light is irradiated from the LED 310*a* to the secondary transfer roller 24, and of the reflected light from the secondary transfer roller 24, the regular reflection components are received by the photodetector 310*b*, and the diffuse reflection components are received by the photodetector 310*c*.

Figure 18:
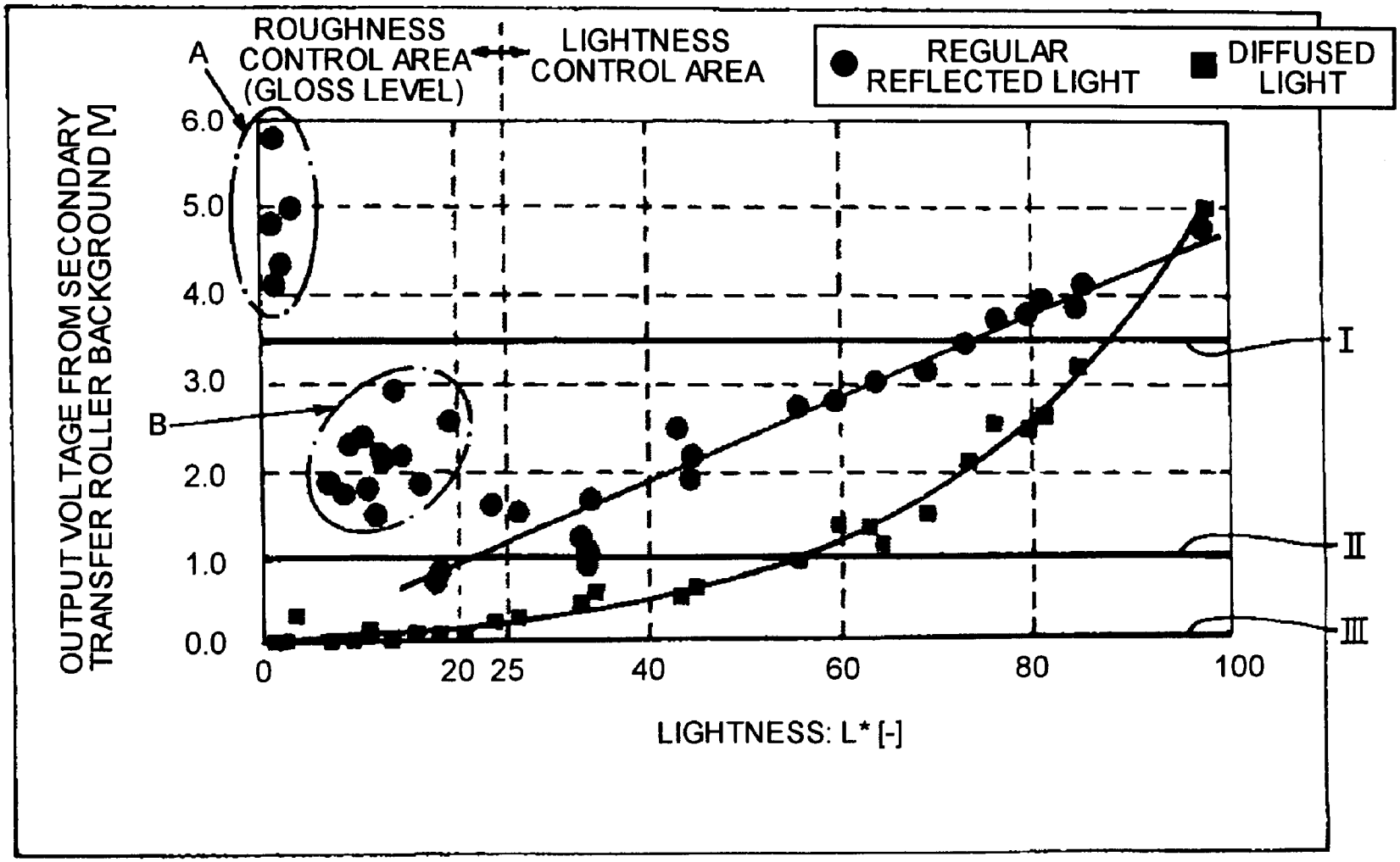
FIG. 18 depicts the relation between lightness and an output voltage of the reflection density sensor with respect to a background of the secondary transfer roller.

FIG. 18 depicts the relation between lightness (L*) and an output voltage of the reflection density sensor 310 with respect to the background of the secondary transfer roller. In FIG. 18, the detection value of A enclosed by a broken line is an output of the regular reflected light when the gloss level (GS) of the secondary transfer roller is GS≧60, and the detection value of B is an output of the regular reflected light when the gloss level (GS) of the secondary transfer roller is GS<60. I in FIG. 18 denotes the output of the diffused light with respect to a color toner solid image, II denotes the output of the regular reflected light with respect to the color toner solid image, and III denotes the output of the regular reflected light with respect to a black toner solid image.

Generally, detection of the regular reflected light uses the fact that the reflected light with respect to the background is interrupted by the toner and decreases. Therefore, in order to improve the S/N ratio, such conditions that the regular reflected light with respect to the background is high and the reflected light with respect to the toner becomes low are preferable. It is seen from FIG. 18 that these conditions are satisfied when the lightness is high, or when the lightness is low and the gloss level is high.

Detection with the diffuse reflected light uses the fact that the diffused light increases since the color toner adheres with respect to the reflected light to the background. Therefore, in order to improve the S/N ratio, such conditions that the diffuse reflected light with respect to the background is low, and the diffuse reflected light with respect to the color toner is high are preferable. It is seen from FIG. 18 that these conditions are satisfied when the lightness is low.

Detection with the diffuse reflected light is not suitable for adjusting the emission amount, since the output with respect to the background is low, but advantageous for detecting a large amount of color toner deposits. Since detection with the regular reflected light is advantageous for adjusting the emission amount and detecting the amount of black toner deposits, since sensitivity with respect to the background is high. Therefore, it has been found that stable detection can be performed by combining these two types of detection, and when the S/N ratio in the black toner output with respect to the background with the regular reflected light, and in the color toner output with respect to the background with the diffuse reflected light is equal to or more than 10. When such conditions are derived from FIG. 18, it is seen that the gloss level is equal to or more than 60, and the lightness is lower than 30, and more preferably, equal to or less than 25.

The embodiments of the present invention have been explained above. When a reference pattern is transferred to the secondary transfer roller 24, being the reference-pattern detecting transfer-body, and detected by the reflection density sensor 310, if the potential of the secondary transfer roller 24 is larger than the reference potential (GND) of the reflection density sensor 310, electrical noise is given to the reflection density sensor 310, thereby deteriorating the S/N ratio. Further, the toner scattered near the secondary transfer roller 24 adheres to the reflection density sensor 310 due to the potential difference between the reflection density sensor 310 and the secondary transfer roller 24, thereby easily contaminating the reflection density sensor 310. Therefore, in the present invention, the secondary transfer roller 24 is, as shown in FIG. 5, in an electrically grounded condition at the time of transfer of the reference pattern. By having such a configuration, the S/N ratio of the reflection density sensor 310 is improved, and contamination of the sensor hardly occurs, thereby enabling stable detection of the optical reflection density with respect to the toner pattern. Therefore, the image forming conditions can be appropriately controlled, and the image forming apparatus having high stability and without toner scattering and greasing can be provided.

As in the above configuration, by setting the potential of the secondary transfer roller 24 to be the same as the reference potential (GND) of the reflection density sensor 310, and applying a transfer field of the same polarity as that of the toner from the backside of the intermediate transfer belt 10, the transfer ratio of the reference pattern from the intermediate transfer belt 10 to the secondary transfer roller 24 can be increased. Specifically, as shown in FIG. 5, the transfer field is applied to the secondary transfer opposing member (here, the backup roller) 16 abutting against the backside of the intermediate transfer belt 10, and facing the secondary transfer roller 24. More specifically, the backup roller 16 as the secondary transfer opposing member is arranged, facing the secondary transfer roller 24, putting the intermediate transfer belt 10 therebetween, on the backside of the intermediate transfer belt 10 at the secondary transfer position. When a transfer bias (repulsive bias) of the same polarity as the charging polarity of the toner constituting the toner image is applied to the backup roller 16 by the voltage bias applying unit 500 connected to the backup roller 16, a transfer field is formed between the grounded secondary transfer roller 24 and the backup roller 16. The toner image carried on the intermediate transfer belt 10 is electrostatically transferred to the secondary transfer roller 24 at the secondary transfer position, thereby forming the reference pattern on the secondary transfer roller 24. By having such a configuration, the transfer ratio is improved, and hence optical reflection density with respect to the reference pattern can be detected highly accurately. The secondary transfer roller 24 is equipped with a secondary transfer roller cleaning apparatus 24*a* is provided, and the reference pattern after detecting the reflection density is removed from the secondary transfer roller 24 by the secondary transfer roller cleaning apparatus 24*a*.

When the regular reflection detecting type sensor as shown in FIG. 13 is used as the reflection density sensor 310, if the gloss level is low with respect to the regular reflection detecting type sensor, a difference in the reflection density between the toner surface and the background surface (the surface of the secondary transfer roller) decreases, and detection may not be possible. In order to prevent this, when the light receiving and emitting direction is in the rotational direction, an error increases, and hence measurement needs to be preformed in a state as close to the flat surface as possible (in the axial direction). Therefore, in the present invention, the gloss level (GS) of the secondary transfer roller 24 in the surface axial direction is set to equal to or more than about 60. By having such a configuration, the reflection density sensor 310 using the regular reflection detecting type sensor can be obtained. The regular reflection detecting type sensor has high sensitivity with respect to the background surface of the secondary transfer roller 24, thereby providing an effect that optical amount can be adjusted by using the background surface.

When a diffuse reflection detecting type sensor is used as the reflection density sensor 310, if the lightness is high with respect to the diffuse reflection detecting type sensor, a difference in the reflection density between the toner surface and the background surface (the surface of the secondary transfer roller) decreases, and detection may not be possible. In order to prevent this problem, in the present invention, the lightness (L*) on the surface layer of the secondary transfer roller 24, in the surface axial direction, is set to be equal to or less than 30, and more preferably, the lightness $\leqq 25$. By having such a configuration, the reflection density sensor 310 using the diffuse reflection detecting type sensor can be obtained. The diffuse reflection detecting type sensor has a characteristic in that the toner in a high deposit amount can be detected, as compared with the regular reflection detecting type sensor. As shown in FIG. 16, adjustment of the quantity of light and detection of the toner in high deposit amount can be achieved, by combining the diffuse reflection detecting type sensor and the regular reflection detecting type sensor (by providing photodetectors 310*b* and 310*c* for receiving the regular reflected light and the diffuse reflected light with respect to one LED 310*a*).

When the transfer bias at the time of transferring the image to the recording material in the secondary transfer unit is applied as well when the reference toner pattern is transferred to the secondary transfer roller 24, excessive transfer occurs, thereby deteriorating the transfer ratio. Therefore, when the reference toner pattern is transferred to the secondary transfer roller 24, the deterioration in the transfer ratio can be prevented by decreasing the applied transfer bias by a predetermined amount. In the present invention, when an image (reference toner pattern) on the intermediate transfer belt 10 is transferred to the secondary transfer roller 24, a transfer bias different from the transfer bias applied to the recording material in the secondary transfer unit is applied. By having such a configuration, the reference toner pattern on the intermediate transfer belt 10 can be transferred to the secondary transfer roller 24 highly efficiently. As a result, the density close to the toner amount transferred to the recording material can be detected by the secondary transfer roller 24, thereby improving the detection accuracy of the reference pattern.

Further, to remove the toner dust to perform efficient transfer, ideal transfer is such that the toner is wrapped and pushed by a material having a low hardness, at the time of transferring the toner image from the intermediate transfer belt 10 to the recording material. However, an elastic body such as rubber is required for decreasing the hardness, but in general, rubber has a low gloss level, and the circularity cannot be made high, thereby decreasing the detection accuracy of the sensor. Therefore, by using a material having low hardness for the backup roller 16 provided on the backside of the intermediate transfer belt 10, and using a material having high hardness for the secondary transfer roller 24, the surface nature and the durability can be improved, thereby dissolving the deficiency of these. Therefore, in the present invention, the hardness of the backup roller 16 provided on the backside of the intermediate transfer belt 10 is set to be lower than that of the secondary transfer roller 24. With such a configuration, the image forming apparatus that has less toner dust, and can improve the detection accuracy of the reference pattern to maintain excellent image quality can be provided.

Figure 19:
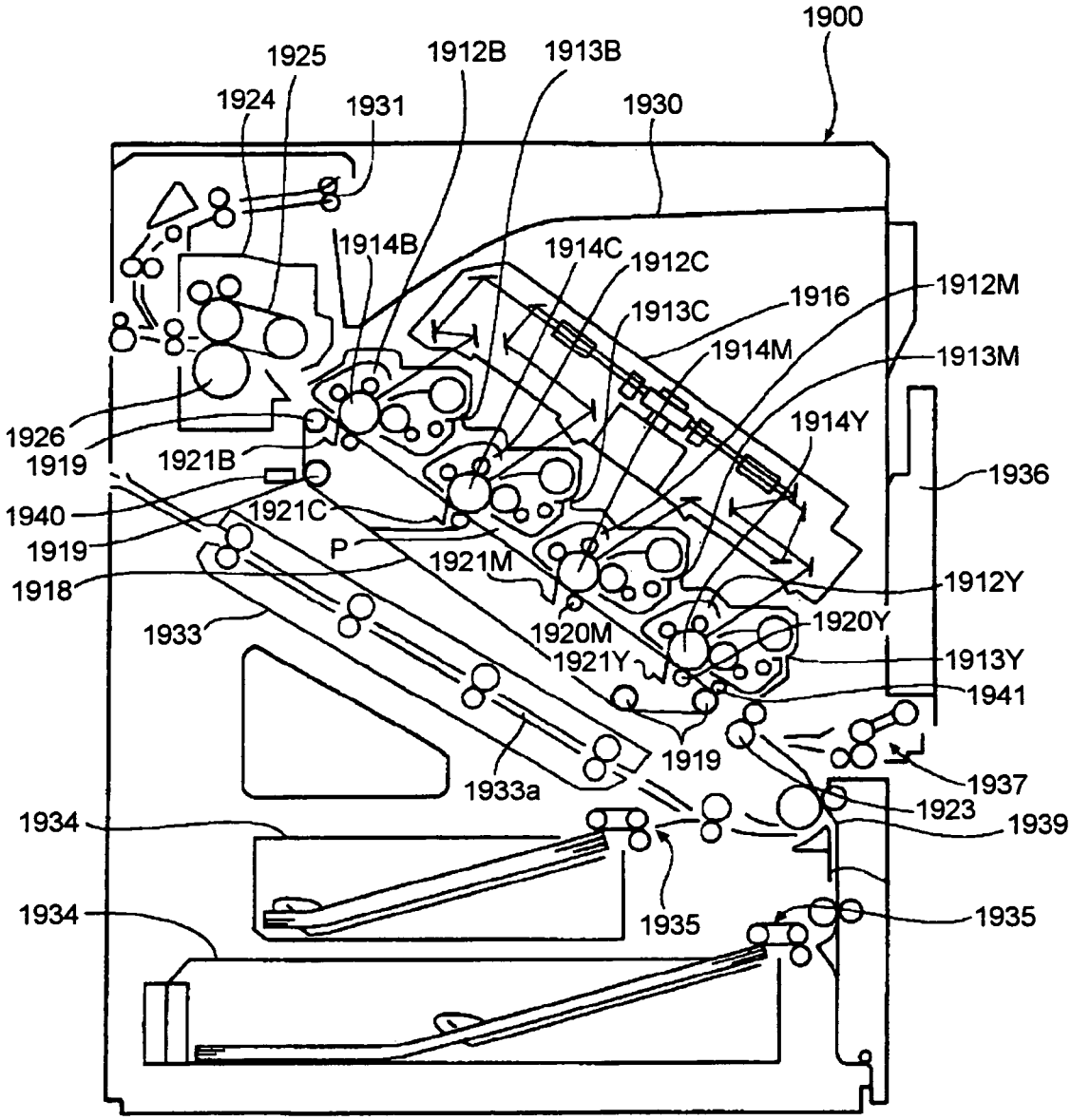
FIG. 19 is a schematic block diagram of a color image forming apparatus according to a third embodiment.

FIG. 19 is a schematic block diagram of a color image forming apparatus 1900 according to a third embodiment.

The color image forming apparatus 1900 has three paper feed trays, that is, one manual feed tray 1936 and two paper feed cassettes 1934 (first paper feed tray) and 1934 (second paper feed tray). The transfer paper fed from the manual feed tray 1936 is carried directly to a resist roller pair 1923 by paper feed rollers 1937, and the transfer paper fed from the first and the second paper feed trays 1934 is carried to the resist roller pair 1923 through intermediate rollers 1939 by paper feed rollers 1935. A resist clutch (not shown) is turned ON at a timing at which the image formed on the photosensitive drum substantially matches with the point of the transfer paper, to carry the paper to a transfer belt 1918. The transfer paper is attracted to the transfer belt 1918 by a bias applied to a paper attracting roller 1941, at the time of passing through a paper attracting nip between the transfer belt 1918 and the paper attracting roller 1941 abutting against the belt, and carried at a process linear velocity of 125 mm/sec.

A transfer bias of a polarity (positive) opposite to the charging polarity (negative) of the toner is applied to transfer brushes 1921B, 1921C, 1921M, and 1921Y arranged at positions facing the photosensitive drums 1914B, 1914C, 1914M, and 1914Y for the respective colors, putting the transfer belt 1918 therebetween, so that the toner images in the respective colors formed on the respective photosensitive drums 1914B, 1914C, 1914M, and 1914Y are sequentially transferred to the transfer paper attracted to the transfer belt 1918, in order of Yellow, Magenta, Cyan, and Black. Reference sign 1920 (in FIG. 19, only Y and M are shown) denotes a pressure roller that holds the transfer belt 1918 with respect to the photosensitive drums 1914B, 1914C, 1914M, and 1914Y at a predetermined pressure.

The transfer paper subjected to the transfer step for respective colors is self-stripped from the transfer belt 1918 by drive rollers 1919 in a transfer belt unit, carried to a fixing unit 1924, and allowed to pass through the fixing nip between a fixing belt 1925 and a pressure roller 1926 so that the toner image is fixed on the transfer paper. Thereafter, in the case of one-side printing, the transfer paper is ejected from a paper ejection roller pair 1931 to an FD tray 1930.

When a two-sided printing mode is selected, the transfer paper having passed through the fixing unit 1924 is sent to a reversing unit (not shown), where the two sides of the transfer paper are reversed in the reversing unit, and the transfer paper is carried to a dual sides carrying unit 1933 located below the transfer unit, and then to the resist roller pair 1923 from a carrier path P3 through the intermediate rollers 1939. Thereafter, the same operation as the process operation to be performed at the time of one-side printing is performed, and the transfer paper passes through the fixing unit 1924 and is ejected to the FD tray 1930.

The image forming unit includes, for each color, an imaging unit 1912B, 1912C, 1912M, or 1912Y having a photosensitive drum 1914B, 1914C, 1914M, or 1914Y, a charging roller and a cleaning unit, and a developing unit 1913B, 1913C, 1913M, or 1913Y. At the time of image formation, the photosensitive drums 1914B, 1914C, 1914M, and 1914Y are rotated by a main motor (not shown), and discharged by an AC bias (containing zero DC component) applied to the charging roller, so that the surface potential thereof becomes a reference potential of about −50 volts.

The photosensitive drums 1914B, 1914C, 1914M, and 1914Y are uniformly charged to a potential substantially equal to the DC components by applying a DC bias superimposed with the AC bias to the charging roller, and the surface potential thereof is charged to substantially −500 to −700 volts (the target charging potential is determined by the process controller). The digital image information sent from a controller as a printer image is converted to a digitized LD emission signal for each color, and irradiated onto the photosensitive drums 1914B, 1914C, 1914M, and 1914Y for each color via a cylinder lens, a polygon mirror, an fθ lens, a first to a third mirrors, and a WTL lens (write unit 1916). As a result, the surface potential on the photosensitive drum at the irradiated portion becomes substantially −50 volts, so that electrostatic latent images corresponding to the image information are formed.

In the development step by the developing units 1913B, 1913C, 1913M, and 1913Y, since DC bias of about −300 to −500 volts superimposed with the AC bias is applied to the developing sleeve, the toner (Q/M: −20 to −30 μC/g) is developed on an image portion of the electrostatic latent images corresponding to the image information of the respective colors on the photosensitive drums, where the potential is decreased due to LD write, to form toner images.

The thus formed toner images on the respective photosensitive drums for the respective colors are transferred to the transfer paper carried by the resist roller pair 1923 and attracted on the transfer belt 1918 by passing through the nip between the transfer belt 1918 and the paper attracting roller 1941, by a bias (transfer bias) of a polarity opposite to the charging polarity of the toner applied to the transfer brushes 1921B, 1921C, 1921M, and 1921Y arranged at positions facing the photosensitive drums, putting the transfer belt therebetween.

In the image forming apparatus of the present invention, prior to the image forming operation, an operation for adjusting out of color registration is performed. Specifically, the execution timing thereof is at the time of power ON, or when the temperature of the optical system increases by predetermined degrees.

Figure 20:
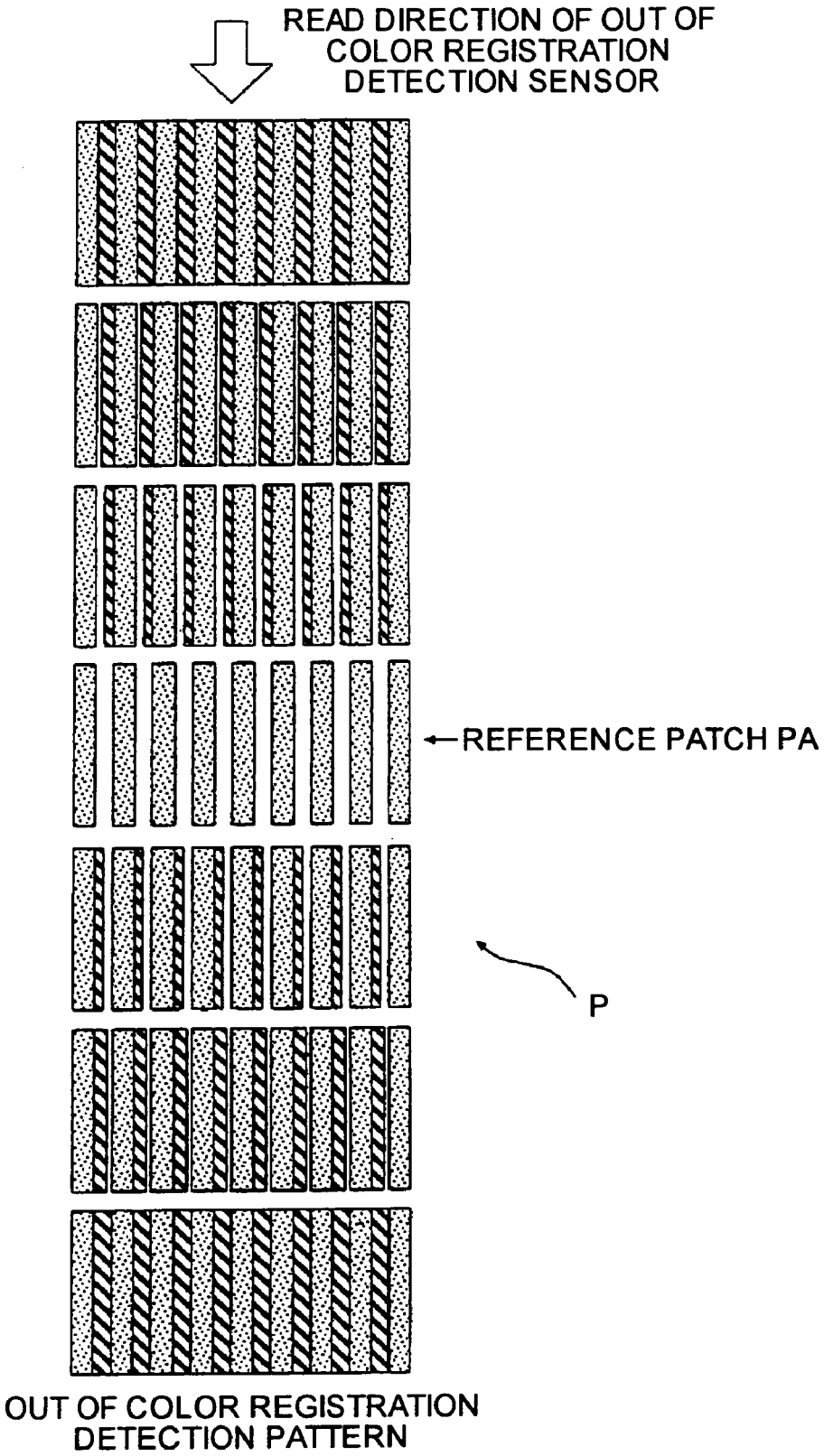
FIG. 20 depicts a misalignment correction pattern in the horizontal scanning direction, formed on the intermediate transfer belt.

An out of color registration sensor in FIG. 19 reads an out of color registration patch group (FIG. 20) formed on the transfer belt 1918. FIG. 20 depicts the out of color registration patterns. A CPU 3400 executes calculation from the output value read by the out of color registration sensor, to execute correction of out of color registration. The transfer belt 1918 constitutes an intermediate transfer body in the present invention.

Figure 21:
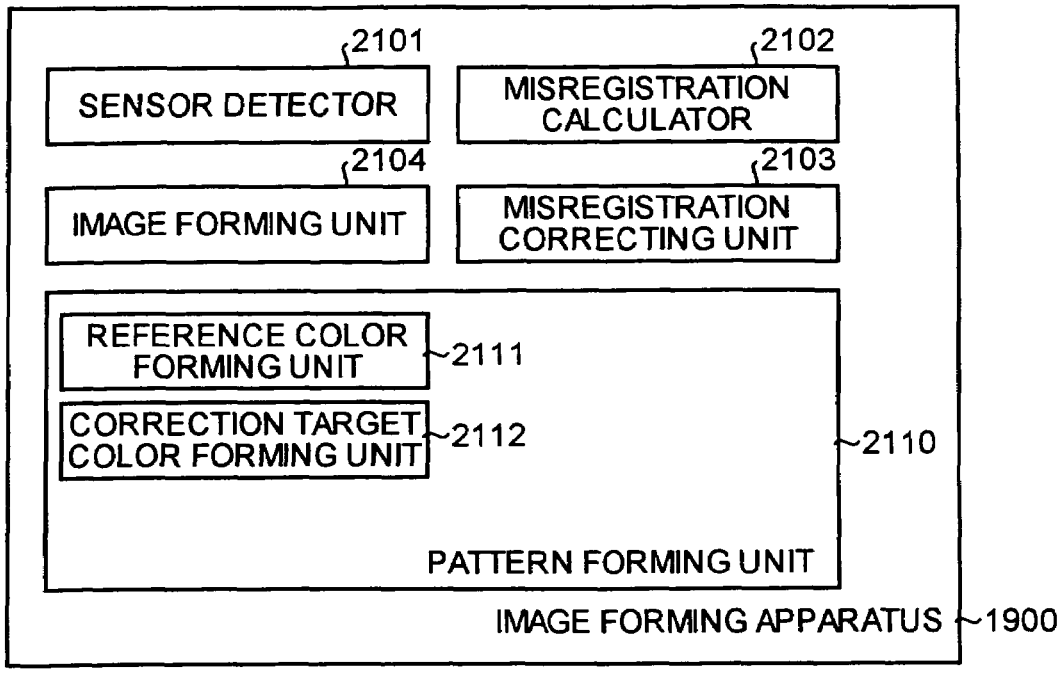
FIG. 21 depicts a functional block in the image forming apparatus according to the third embodiment.

FIG. 21 depicts a functional block in the image forming apparatus 1900 in this embodiment. A pattern forming unit 2110 constitutes a pattern forming unit in the present invention, and forms the out of color registration pattern on the transfer belt 1918. A sensor detecting unit 2101 constitutes a detecting unit in the present invention, and the output value read by the out of color registration sensor 1940 is input thereto. An out of color registration calculating unit 2102 constitutes a calculating unit in the present invention, and calculates the amount of out of color registration based on the read output value. An out of color registration correcting unit 2103 constitutes a correcting unit in the present invention, and corrects the out of color registration based on the amount of out of color registration calculated by the out of color registration calculating unit 2102. The image forming unit 2104 forms a color image at a position where the out of color registration is corrected. The pattern forming unit 2110 includes a reference color forming unit 2111 and a correction target color forming unit 2112. The correction target color forming unit 2112 constitutes a first forming unit in the present invention, and forms a correction target color pattern including a plurality of lines when the out of color registration patterns are formed. The reference color forming unit 2111 constitutes a second forming unit in the present invention, and forms a reference color pattern including a plurality of lines when the out of color registration patterns are formed. The calculation method of a position of out of color registration by the out of color registration calculating unit 2102 will be described later.

Figure 26:
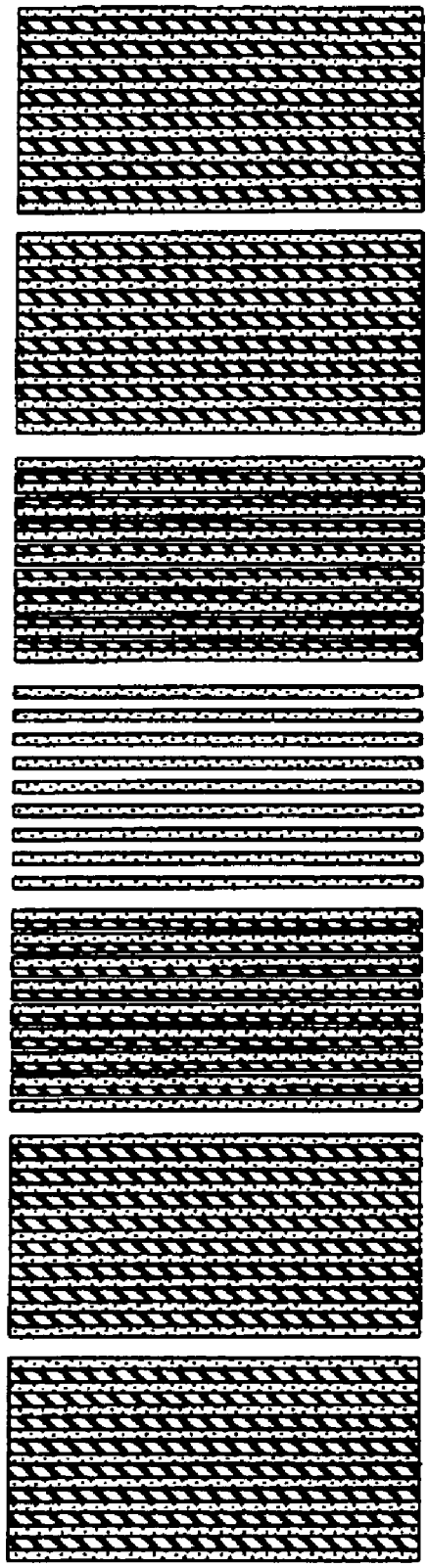
FIG. 26 depicts an out of color registration correction pattern in the vertical scanning direction, formed on the intermediate transfer belt.

The patterns shown in FIG. 20 are out of color registration correction patterns for the horizontal scanning direction (equal to misalignment, the same hereinafter). As out of color registration correction patterns for the vertical scanning direction, a patch group formed in a direction perpendicular thereto, as shown in FIG. 26, may be used as the correction patterns. That is, lines are formed in parallel in the vertical scanning direction (a direction orthogonal to the traveling direction of the transfer belt 1918).

Figure 22:
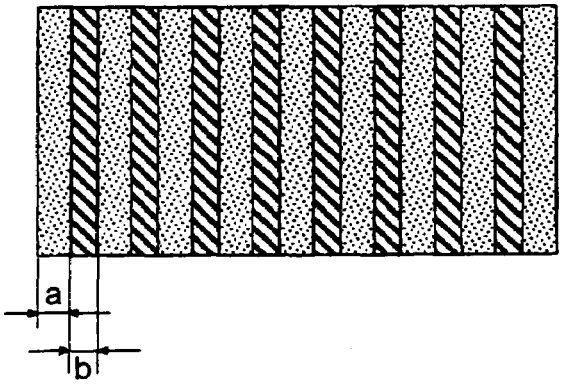
FIG. 22 depicts details of a misalignment detection pattern formed on the intermediate transfer belt.

One patch in the out of color registration detection patch group in the present invention has a configuration such that, as shown in FIG. 22, on a pattern in which a color toner, being the correction target color (C, M, or Y indicated by hatching), is formed in a plurality of numbers, in a predetermined line width: a, at a line interval: b equal thereto (=a), a pattern of the Bk toner, being the reference color, in which the Bk toner (indicated by halftone dots) is formed in the equal line width: a at the equal line interval: b, is superposed.

With respect to this patch, as shown in FIG. 20, a patch in which the color toner completely overlaps on the black reference color is designated as a reference patch PA. With respect to this reference patch PA, a plurality of continuous patch groups are formed, in which the relative positions thereof are shifted by an optional amount in parallel with the line forming direction, on this side in the read direction of the sensor. Further, with respect to the reference patch PA, a plurality of continuous patch groups are formed, in which the relative positions thereof are shifted by an optional amount in the opposite direction, on the other side in the read direction of the sensor, and the patch group P is designated as the out of color registration correction pattern.

The sensor reads this correction pattern. As the sensor, a reflection type density photosensor is advantageous in view of the cost, and the reflection type sensor includes a sensor that detects the regular reflection components, and a sensor that detects the diffuse reflection components. The sensor that detects the diffuse reflection components is advantageous in view of the accuracy. On the other hand, the sensor that detects the regular reflection components may be used from the viewpoint of misalignment control accuracy, but has poor controllability, as compared with the sensor that detects the diffuse reflection components. However, since the sensitivity near the reflectivity on the background of the surface to be detected is high, the sensor that detects the regular reflection components is used together with the sensor that detects the diffuse reflection components with respect to the LED, for adjusting the quantity of light of the LED.

An instance in which the sensor that detects the diffuse reflection components (corresponding to a second photodetector 3303 described later) is used to read the image by the diffused light output from the out of color registration correction pattern will be explained as an example. In the reference patch PA, the diffused light from the transfer belt 1918, being the background of the patch, and the diffused light from a plurality of black line portions are combined to form the combined output.

It is important herein to set the diffuse reflection output with respect to the transfer belt 1918 and the black toner low, and the diffuse reflection output with respect to the color toner high, and to make the difference therebetween large. This is very important in the present invention, and hence will be explained later in detail.

The respective patch length (patch width), being the length in the read direction of the sensor, the patch interval, and the spot diameter of the sensor on the transfer belt 1918 have the following relation:

Patch length+patch interval>spot diameter of sensor on transfer body×2.

Figure 23:
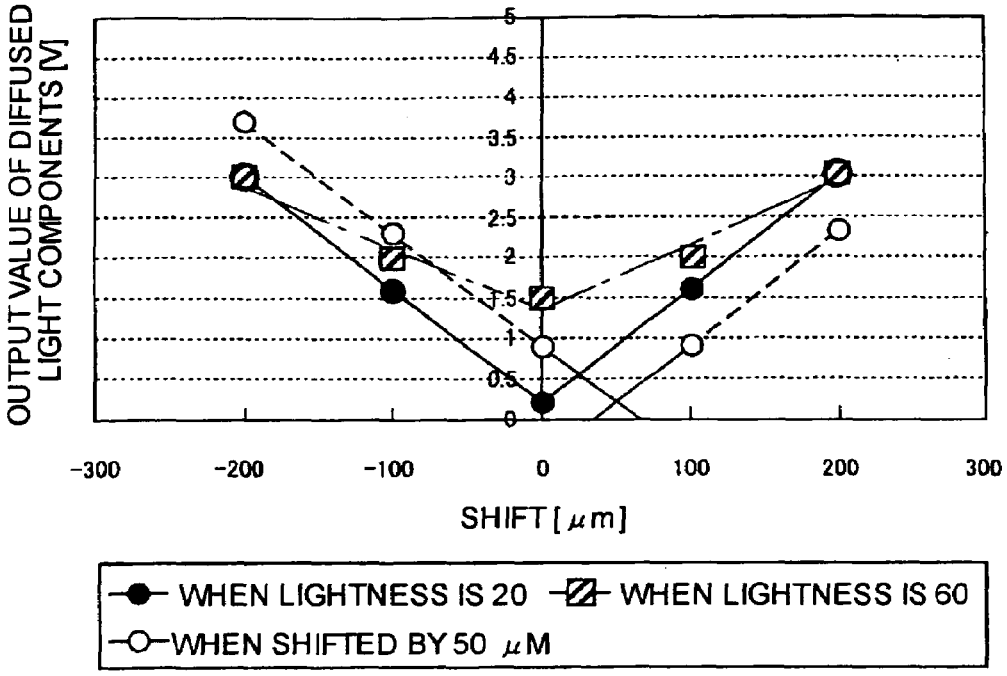
FIG. 23 depicts detection outputs from shifted patch groups, when a write position of color is shifted by 50 micrometers, and when the lightness L* is 20 and when the lightness L* is 60.

When either color (this may be black, being the reference color, or a correction target color) is shifted with respect to the reference patch PA by an optional amount, a predetermined diffused light output is returned from the color toner, being the correction target color. Therefore, the diffused light output value obtained from the patch group P, in which the correction target color is gradually shifted by an optional amount, increases corresponding to the shift. When a patch in which the correction target color is shifted by an optional amount to the opposite side of a reference patch PA is considered, the same output value is obtained. Therefore, when this detection value is plotted with respect to a preset optional shift, the output result as shown in FIG. 23 can be obtained.

That is, this uses the fact that the relation of the output from the black toner and the transfer belt<the output from the color toner is established, with respect to the diffused light output from the background of the transfer belt 1918, the black toner, and the color toner.

When out of color registration is detected and corrected by such an out of color registration correction pattern, it is desired that the black toner be on the upper side. Therefore, when considering the relation of the imaging sequence of the respective color toner images on the transfer belt 1918, it is desired that the imaging station of the black toner is located on the most downstream side.

Further, when the transfer belt 1918 itself is made black, using a difference in reflectivity established between the diffused light outputs from the transfer belt 1918, the black toner, and the color toner, the following relation can be obtained output from black toner≈output from transfer belt, therefore, higher output difference can be obtained. As a result, more accurate detection of out of color registration becomes possible.

Figure 30:
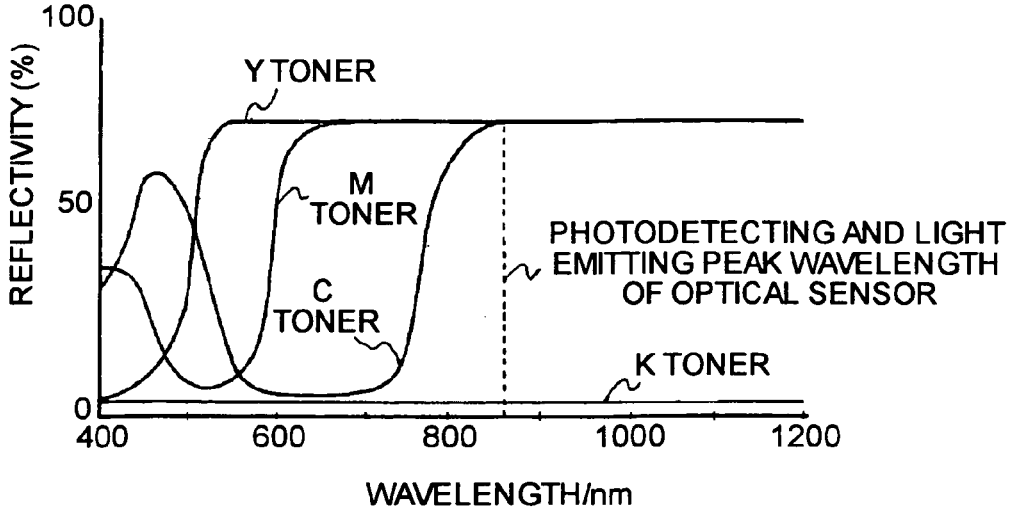
FIG. 30 depicts a spectral reflection factor characteristic of respective color toners.

It is important for forming the out of color registration detection pattern that how much the detection output difference between the transfer belt, the black toner, and the color toner should be taken. FIG. 30 depicts a spectral reflection factor characteristic (total reflection) of respective color toners. In FIG. 30, photodetecting and light emitting peak wavelength of the misalignment detecting optical sensor used in this embodiment is 870 nanometers, and the color toner has sufficiently high reflectivity than the black (K) toner. Therefore, in the method of using the misalignment sensor in the embodiment, it is very important how to suppress the diffuse reflection output in the background of the transfer belt 1918.

Figure 33:
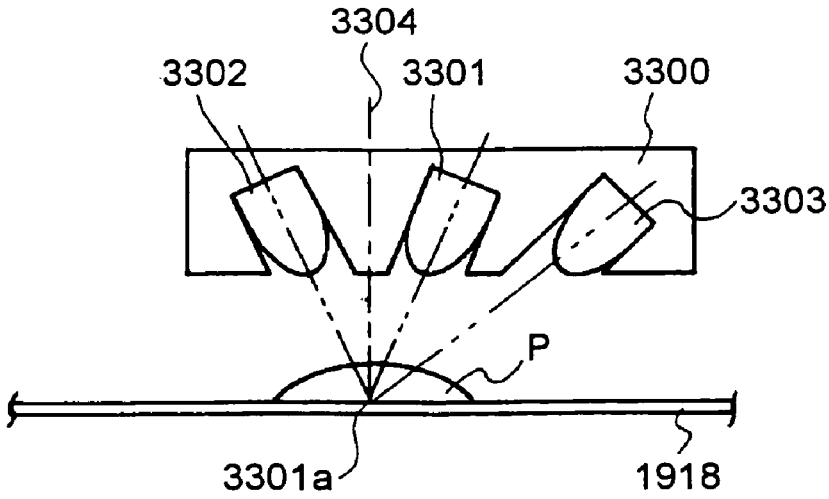
FIG. 33 schematically depicts a reflection-type photosensor according to the third embodiment.

FIG. 33 depicts the photodetecting state of the regular reflection components and diffuse reflection components of the reflection-type photosensor according to the embodiment. In FIG. 33, the reflection-type photosensor 3300 includes an LED 3301, a first photodetector 3302 that detects the regular reflection components, and a second photodetector 3303 that detects the diffuse reflection components. The first photodetector 3302 is arranged so that the optical axis is positioned symmetrically to the extension of the optical axis of the LED 3301 toward the transfer belt 1918, centering on a normal 3304 passing through a point

3301*a* on the extension, and the second photodetector 3303 is provided on the same side as the LED 3301 with respect to the normal 3304, and away from the normal than the LED 3301, so that the extension of the optical axis of the second photodetector 3303 is positioned at the point 3301*a*.

Figure 31:
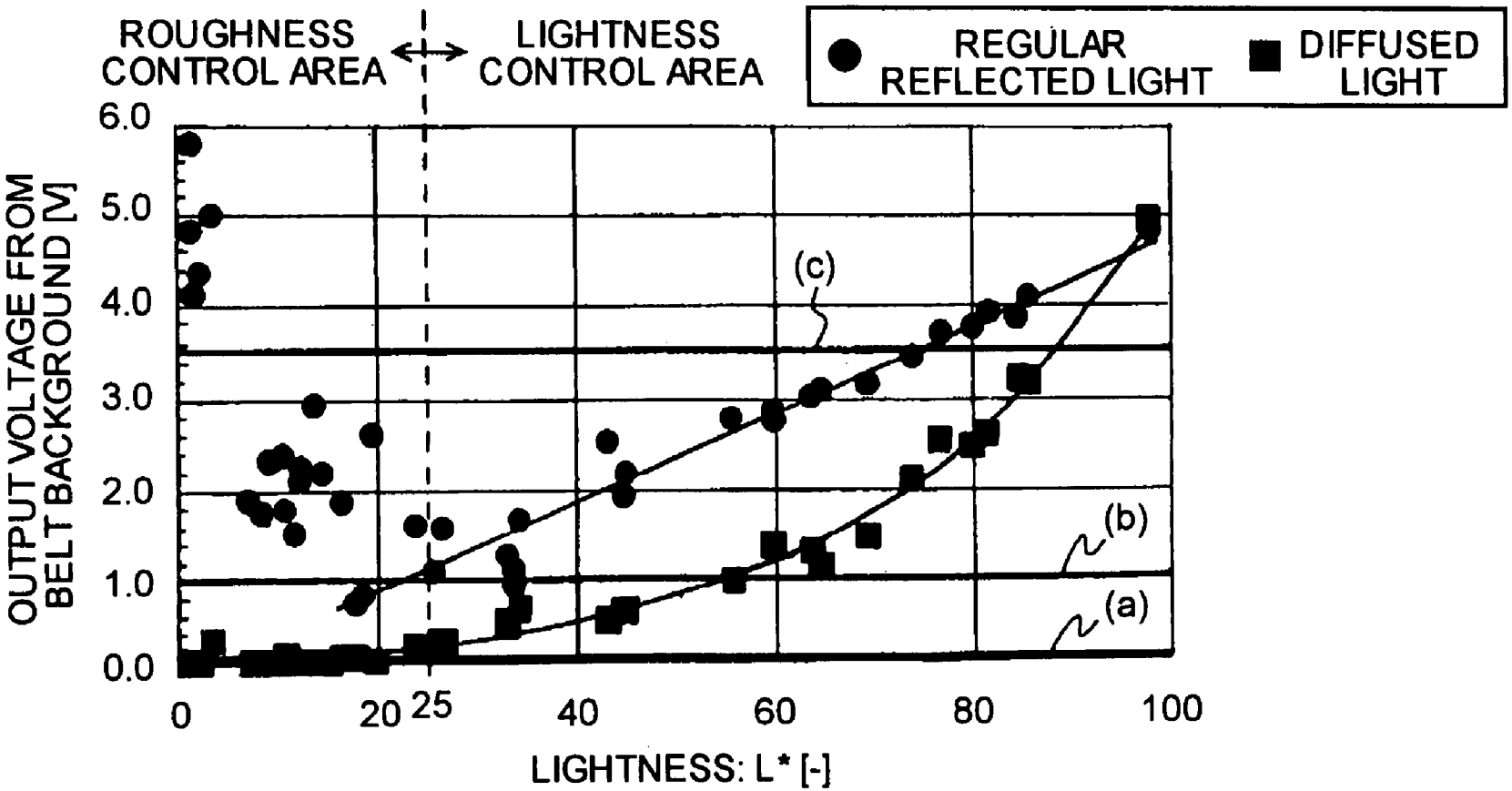
FIG. 31 depicts the relation between the lightness and the output voltage from the belt background.

FIG. 31 depicts the results of study relating to what kind of characteristics of the transfer belt 1918 contributes to the regular reflection and diffuse reflection components. FIG. 31 depicts the relation between the regular reflection components and diffuse reflection components by changing the surface roughness and the lightness of the transfer belt 1918. The lightness is measured by using X-rite 938 manufactured by X-Rite under observation conditions of light source: D50 and angle of visibility: 2 degrees.

Black lines parallel to the X axis (indicated by (a), (b), and (c) from the bottom) indicate an output by the regular reflected light with respect to the black toner solid image (a), an output by the regular reflected light with respect to the color toner solid image (b), and an output by the diffused light with respect to the color toner solid image (c). As seen from FIG. 31, the diffused light indicates a lower output as the lightness decreases, and it has been found that S/N sufficient for the output of the color toner (equal to or more than 10 times) can be ensured with the lightness of $L^* \leqq 25$.

Figure 32:
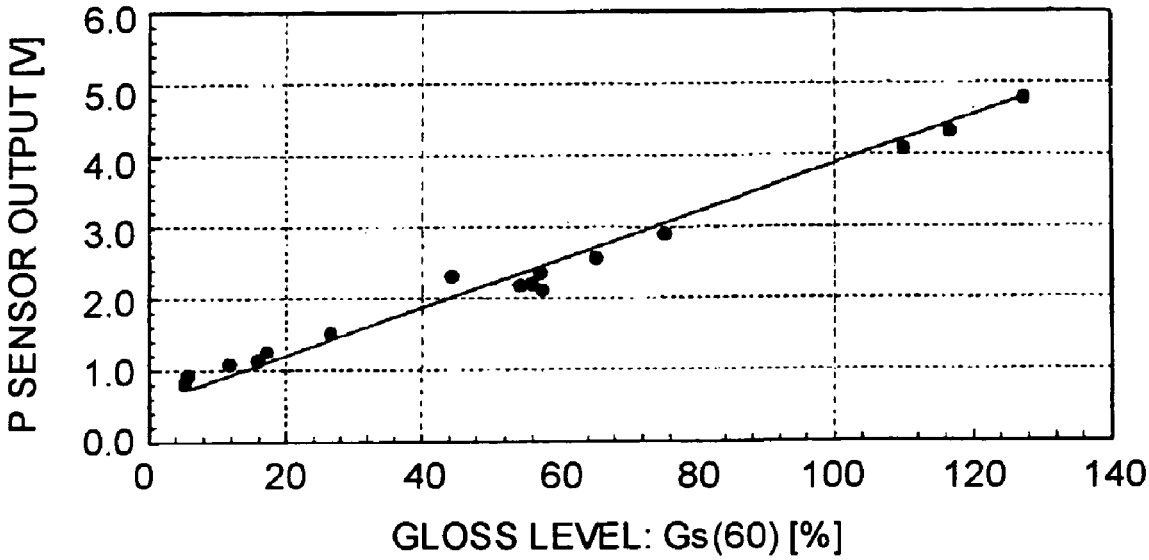
FIG. 32 depicts the relation between the gloss level and the sensor output.

As the lightness decreases, the regular reflected light also decreases, but the correlation collapses in the region of $L^* \leqq 25$. This is because in the first photodetector 3302 that receives the regular reflection components in FIG. 33, contribution of the regular reflection components increases than that of the diffuse reflection components, and it can be considered that this is a phenomenon occurring because the photodetecting amount of the regular reflection components is different due to the surface roughness. Therefore, experiments have been performed by changing the gloss level, for the transfer belt having the lightness of $L^* \leqq 25$, and the result shows excellent linear relationship as shown in FIG. 32.

For the measurement of the gloss level, a gloss meter PG-1M manufactured by Nippon Denshoku Industries Co. Ltd. is used. The measurement is performed conforming to JISZ8741, by using GS (60 degrees) until the gloss level of 70, and GS (20 degrees) exceeding the gloss level of 70. For FIG. 32, however, all gloss levels are measured by GS (60 degrees) in order to observe the correlation with wider gloss level. Even if the angle of visibility is changed, the tendency itself does not change.

A solid output (b) with respect to the color toner is about 1 volt, and a solid output (a) with respect to the black toner is about 0.2 volt. The reason why the solid output of the color toner is higher than that of the black toner is that the diffused components of the color toner are mixed. As seen from FIG. 32, the regular reflected light shows higher output with an increase in the gloss level, and it has been found that S/N sufficient for the black toner (equal to or more than 10 times) can be ensured with the gloss level GS(60): equal to or more than 60.

In the present invention, misalignment detection is based on the fact that when the area of the color toner increases with respect to the black toner, the diffused light increases. Since the black toner absorbs the emitted light from the LED 3301 in the reflection-type photosensor 3300, the regular reflected light and diffused reflection light (diffused light) with respect to the black toner approach zero. Therefore, as the diffused light from the background of the transfer belt 1918 becomes lower with respect to the color toner, the output difference of the photodetector 3302 increases, thereby detection with excellent sensitivity can be performed. The gloss level is set to $L^* \leqq 25$, since the diffuse reflection output from the belt background becomes 1/10 or below, with respect to the diffused light output with respect to the solid image of the color toner.

On the other hand, when the lightness of the transfer belt 1918 is decreased, a difference between the quantity of light of the diffused light with respect to the black toner and the quantity of light of the diffused light with respect to the belt background decreases. When this difference decreases, a difference between the detection outputs also decreases, thereby making it difficult to detect the amount of black toner deposits using the diffused light. In order to detect the amount of black toner deposits, as the amount of regular reflected light of the belt background of the transfer belt 1918 increases with respect to the black toner, the detection sensitivity increases. The gloss level is set so that the detected output of the regular reflected light from the belt background becomes 2.5 volts, which is about twenty times as large as the detected output of the regular reflected light with respect to the black toner solid image, 0.12 volt. From this point, it is desired that the gloss level GS (60 degrees) $\geqq 60$, as shown in FIG. 32.

As the resin can be used one or two or more kinds of resins selected from the group consisting of styrene resins (monopolymer or copolymer including styrene or styrene substitution product) such as polycarbonate, fluororesin (ETFE, PVDF), polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylic ester copolymer (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylic ester copolymer (styrene-methyl methacrylate copolymer, styrene-ethyl methacrylate copolymer, and styrene-phenyl methacrylate copolymer), styrene resins (monopolymer or copolymer including styrene or styrene derivative substitutions), such as styrene-α-methyl chloroacrylate copolymer and styrene-acrylonitrile-acrylic ester copolymer, methyl methacrylate resin, butyl methacrylate resin, ethyl acrylate resin, butyl acrylate resin, denatured acrylic resins (silicone denatured acrylic resin, vinyl chloride resin-denatured acrylic resin, acyrylic urethane resin, and the like), vinyl chloride resin, styrene-vinyl acetate copolymer, vinyl chloride-vinyl acetate copolymer, rosin-denatured maleic resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, denatured polyphenylene oxide resin, and the like. However, in the present invention, the resin is not limited to those materials.

As the elastic rubber and elastomers can be used one or two or more kinds of elastomers selected from the group consisting of butyl rubber, fluorocarbon rubber, acrylic rubber, EPDM, NBR, acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1, 2-polybutadiene, epichlorohydrin rubber, silicone rubber, fluoro rubber, polysulfide rubber, polynorbornene rubber, hydrogenated nitrile rubber, and thermoplastic elastomers (for example, polystyrene resin, polyolefin resin, polyvinyl chloride resin, polyurethane resin, polyamide resin, polyurea resin, polyester resin, and fuluororesin). However, in the present invention, the rubber is not limited to those materials.

There is no particular limitation in the resistance adjusting conductant agent, but for example, metal powders such as carbon black, graphite, aluminum, and nickel, and conductive metal oxides such as tin oxide, titanium oxide, antimony oxide, indium oxide, potassium titanate, antimony oxide-tin oxide complex oxide (ATO), and indium oxide-tin oxide complex oxide (ITO) can be mentioned. The conductive metal oxides may be covered with nonconductive particulates such as barium sulfate, magnesium silicate, and calcium carbonate. However, in the present invention, the resistance adjusting conductant agent is not limited to those conductant agents.

It is required for the surface layer to prevent contamination of the photosensitive drum due to the elastic material, reduce the skin resistance against the surface of the transfer belt, and reduce the adhesion of toner, to increase the cleaning property and the secondary transfer property. Therefore, for example, one or two or more kinds of polyurethane, polyester, and epoxy resins are used for the surface layer materials, and powders or particles such as fluororesin, fluorine compound, carbon fluoride, titanium dioxide, and silicon carbide, which reduce the surface energy and increase lubricity, may be dispersed thereon in one or two or more kinds, or by changing the particle sizes. Further, a material in which a layer with full of fluorine is formed on the surface by performing thermal processing, to reduce the surface energy, such as the fluoro rubber material, may be used.

The elastic belt is manufactured, for example, by methods:

(1) a centrifugal molding method in which a material is-poured into a rotating cylindrical mold to form a belt;
(2) a spray coating method in which a liquid paint is sprayed to form a film;
(3) a dipping method in which a cylindrical mold is immersed in a material solution and lifted;
(4) a casting method of casting a material in an inner mold and an outer mold; and
(5) a method in which a compound is wound around a large cylindrical mold to perform vulcanizing polishing, but the present invention is not limited thereto, and generally a plurality of manufacturing methods are combined.

The elastic belt used in the embodiment was manufactured in the following manner.

That is, a cylindrical mold was immersed in a dispersion liquid, in which 18 parts by weight of carbon black, 3 parts by weight of a dispersing agent, and 400 parts by weight of toluene were uniformly dispersed with respect to 100 parts by weight of PVDF, and the mold was quietly lifted at a speed of 10 mm/sec, and dried at a room temperature, to form a uniform PVDF film of 75 micrometers. The mold with the 75 micrometers film formed thereon was immersed in the solution under the above conditions repetitively, was quietly lifted at a speed of 10 mm/sec, and dried at a room temperature, to form a PVDF belt of 150 micrometers. The cylindrical belt with the 150 micrometers PVDF formed thereon was further immersed in a dispersion liquid, in which 100 parts by weight of polyurethane polymer, 3 parts by weight of a curing agent (isocyanate), 20 parts by weight of carbon black, 3 parts by weight of a dispersing agent, and 500 parts by weight of methyl ethyl ketone (MEK) were uniformly dispersed, lifted at a speed of 30 mm/sec, and dried naturally. After the belt was dried, the process was repeated to form a urethane polymer layer of the intended thickness of 150 micrometers, thereby obtaining a two-layer transfer belt.

It is important that the lightness is $L^* \leqq 25$, when using the reflection type sensor (the second photodetector 3303) that detects the diffuse reflected light, and that the gloss level (GS) is equal to or more than 60, when using the reflection type sensor (the first photodetector 3302) that detects the regular reflected light.

The calculation method for calculating the amount of out of color registration by the out of color registration calculating unit 2102 from the output values of such a transfer belt and pattern is as follows.

In the ideal state in which out of color registration does not exist, as shown in FIG. 23, the output becomes the minimum in the reference patch PA. Therefore, by determining the value on the X axis, at an intersection of two segments at the opposite sides of the output minimum value, the amount of deviation can be calculated. That is, from following simultaneous equations $$y=ax+b$$

$$y=cx+d,$$

$x=(d-b)/(a-c)$ can be calculated.

When considering an instance when out of color registration has occurred, the output values of the respective patches change corresponding to the amount of out of color registration. Therefore, by determining the intersection of two segments obtained from the respective output values, the amount of out of color registration can be similarly calculated.

FIG. 23 depicts the calculation of the amount of out of color registration, when the shift of the respective patches is 100 micrometers, and the amount of deviation is 50 micrometers. The output minimum value is at a point of 0 micrometer and 100 micrometers on the X axis, but even if the whole data is used as a calculated value, there is no problem. However, if the amount of deviation is 75 micrometers, processing for determining for which calculation of two segments the minimum value should be used is required. Therefore, it is desired to exclude the minimum value (or the maximum value) from the calculation. From FIG. 23, it is seen that the sensitivity and the linearity are different when the belt lightness L* is 20 and 60.

As a result of experiments, in the region of $L^* \leqq 25$, the correlation coefficient in the collinear approximation is equal to or more than 0.95, but the correlation coefficient deteriorates from the region exceeding $L^*=25$, thereby decreasing the detection accuracy of out of color registration. In FIG. 23, it is shown that the accuracy is better when the lightness L* is 20 than when L* is 60.

In the embodiment, from the out of color registration correction principle of the out of color registration pattern and the calculation means, the respective line width is set to 0.5 millimeter, the line interval is set to 0.5 millimeter, and the shift of the respective patches is assumed to be 100 micrometers, and 10 patches, each having the size of 12×12 millimeters, are formed to perform detection of the amount of out of color registration.

Figure 24:
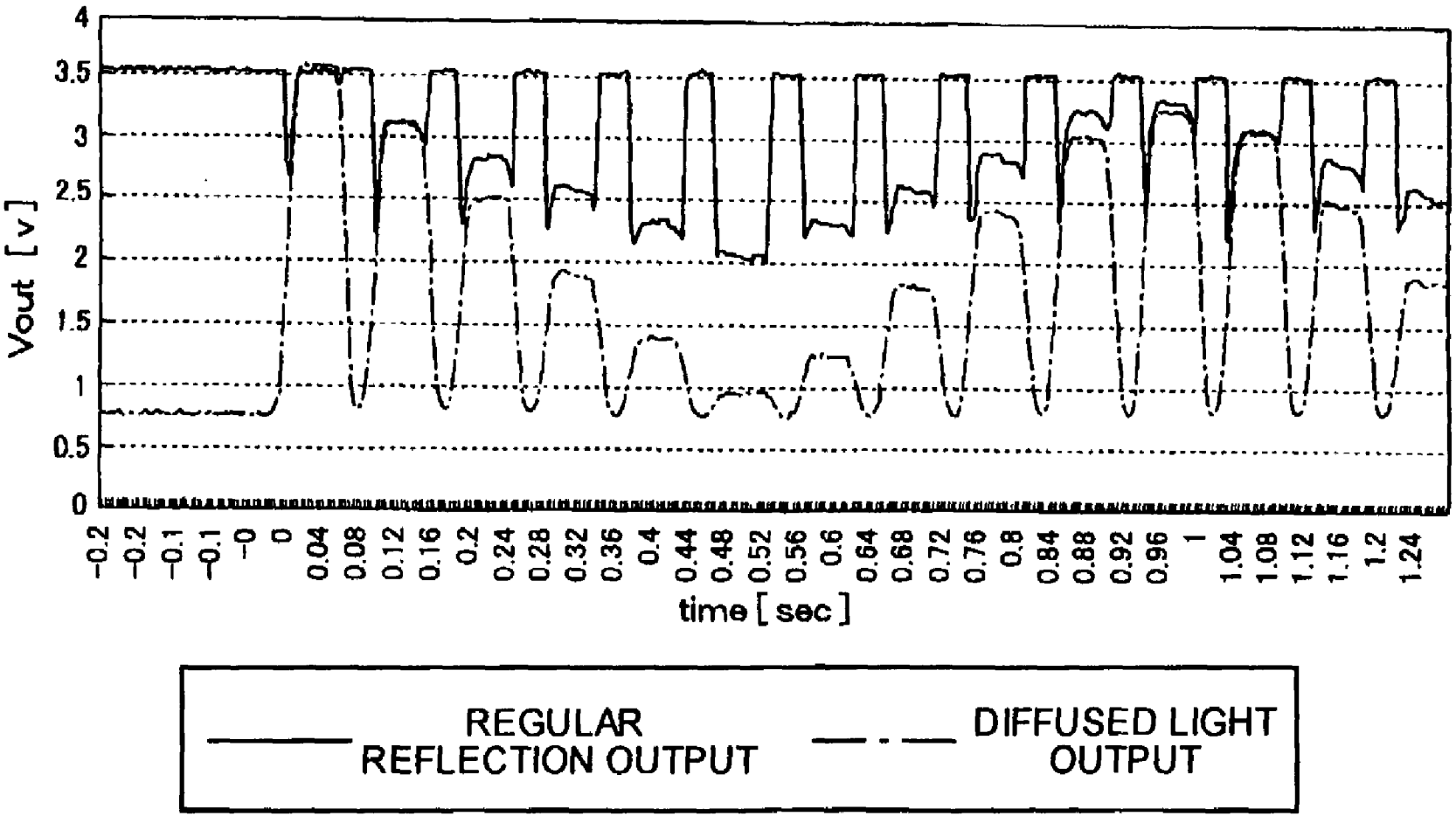
FIG. 24 depicts sensor output waveforms, when the respective line width in the correction pattern is 0.5 millimeter, the line interval is 0.5 millimeter, and the shift of respective patches is 100 micrometers, and when ten patches respectively having a size of 12×12 millimeters are formed to detect the amount of out of color registration.

The sensor output waveform is shown in FIG. 24 (time is plotted on the X axis, and the output value is plotted on the Y axis). In this embodiment, reflection-type photosensors 3302 and 3303 including the LED and photodetectors that can obtain both the regular reflection output and the diffuse reflection output are used as the out of color registration sensor. In the embodiment, the photodetector 3302 that detects the regular reflection output is provided as a toner deposit sensor for the Bk toner. This is because with the Bk toner, the diffuse reflection output cannot be obtained. As seen from FIG. 24, however, the sensitivity is lower than the diffused light detection method, but detection is possible with respect to the position, and control of misalignment by the misalignment detection and control of image density and toner supply by the toner deposit detection can be performed only with the photodetector 3302 that detects the regular reflection components, by setting the gloss level GS (60 degrees) to equal to or more than 60. In the sensor output waveform in FIG. 24, it is seen that after 0.5 second and 1 second since detection start of the pattern, the black (K) toner and the color toner are detected in a substantially superposed state.

When such a misalignment detection is performed by the diffuse reflection detection (the photodetector that detects the diffuse reflection components) and the regular reflection detection (the photodetector that detects the regular reflection components), since the detection patterns are continuously formed with respect to the traveling direction of the transfer belt 1918, a change in the output with respect to the background in the traveling direction of the transfer belt 1918 affects the detection accuracy. When the influence when a partial change occurs is determined from the relations in FIG. 31 and FIG. 32, the lightness L* allowed for the diffuse reflection detection is 10 in width (±5 with respect to the average lightness for one cycle of the belt), and the gloss level GS (60) allowed for the regular reflection detection is 10 in width (±5 with respect to the average gloss level for one cycle of the belt).

Figure 25:
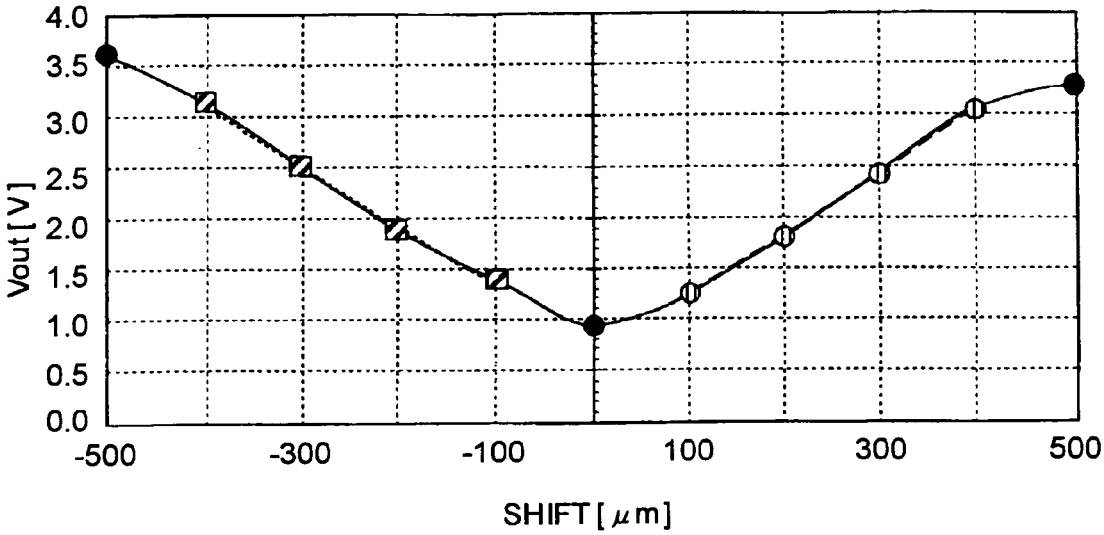
FIG. 25 is a graph in which an output value obtained by sampling in predetermined numbers by a predetermined sampling cycle, and designating the output mean value thereof as the sensor output value of respective patches is plotted with respect to the shift.

A result of reading and plotting the output of the diffuse reflection components in FIG. 24 is shown in FIG. 25. The calculated value of the intersection of two segments is 1.31 micrometers. Further, a pattern in which the shift is optionally shifted is prepared to determine an error with respect to the ideal value of the shift. Since the results indicate 10 micrometers or less, it can be confirmed that with such a method, out of color registration can be sufficiently detected.

Figure 27:
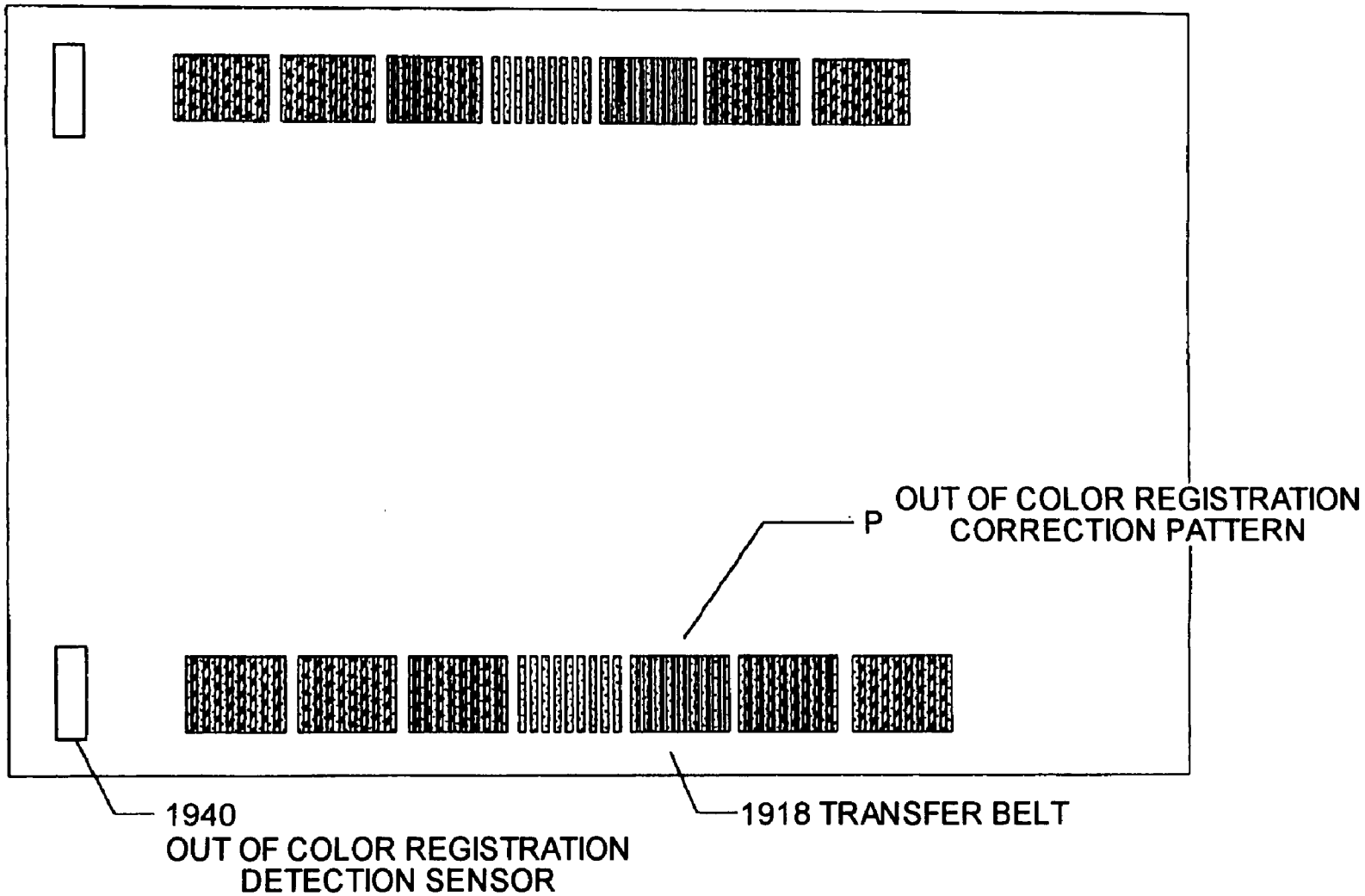
FIG. 27 is a plan view of the relation between a patch formed on the intermediate transfer belt and the out of color registration sensor.

Patches shown in FIG. 27 are formed at the opposite ends of the transfer belt 1918, and by obtaining the sensor output from the patches, correction of the amount of skew as well as correction of deviation in the horizontal scanning and the vertical scanning can be easily performed.

When such patches are used, the detection error can be considerably reduced, since the deviation can be directly calculated relating to the deviation in the horizontal scanning, as compared with the conventional method of detecting the amount of out of color registration by a combination of horizontal lines and diagonal lines.

By providing a predetermined interval between these patch groups, a trailing output of the regular reflected light can be obtained in each patch. As a result, the output values different for each patch in the diffused light output can be easily detected.

Figure 28:
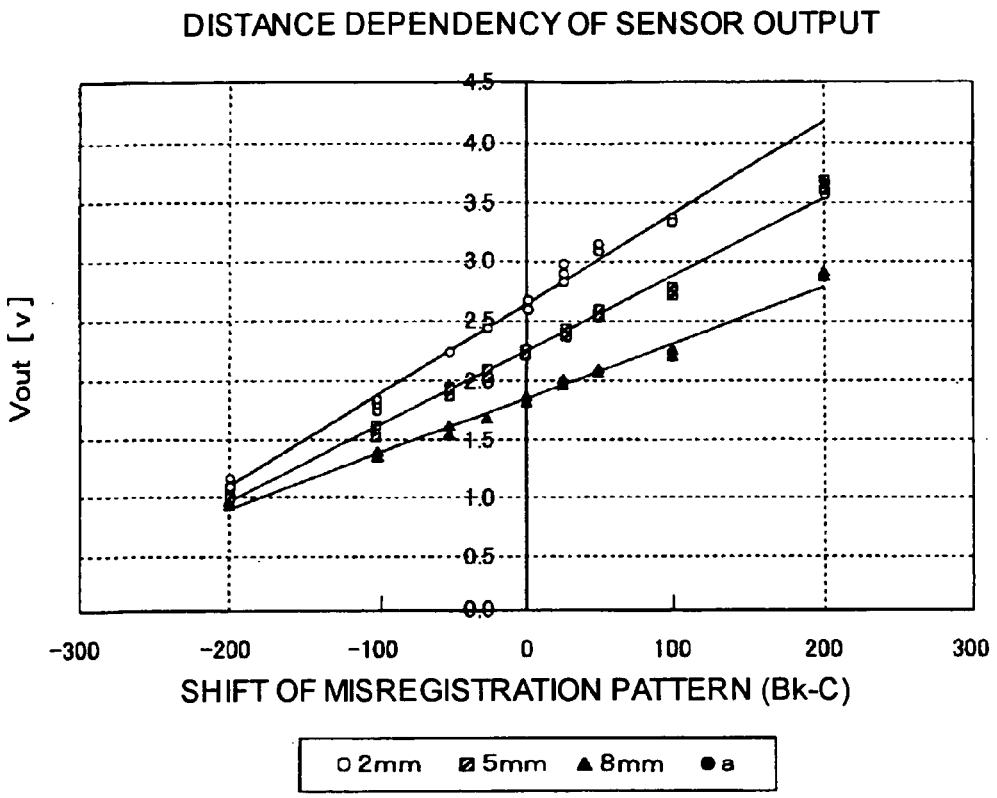
FIG. 28 depicts distance dependency of the sensor output.
Figure 29:
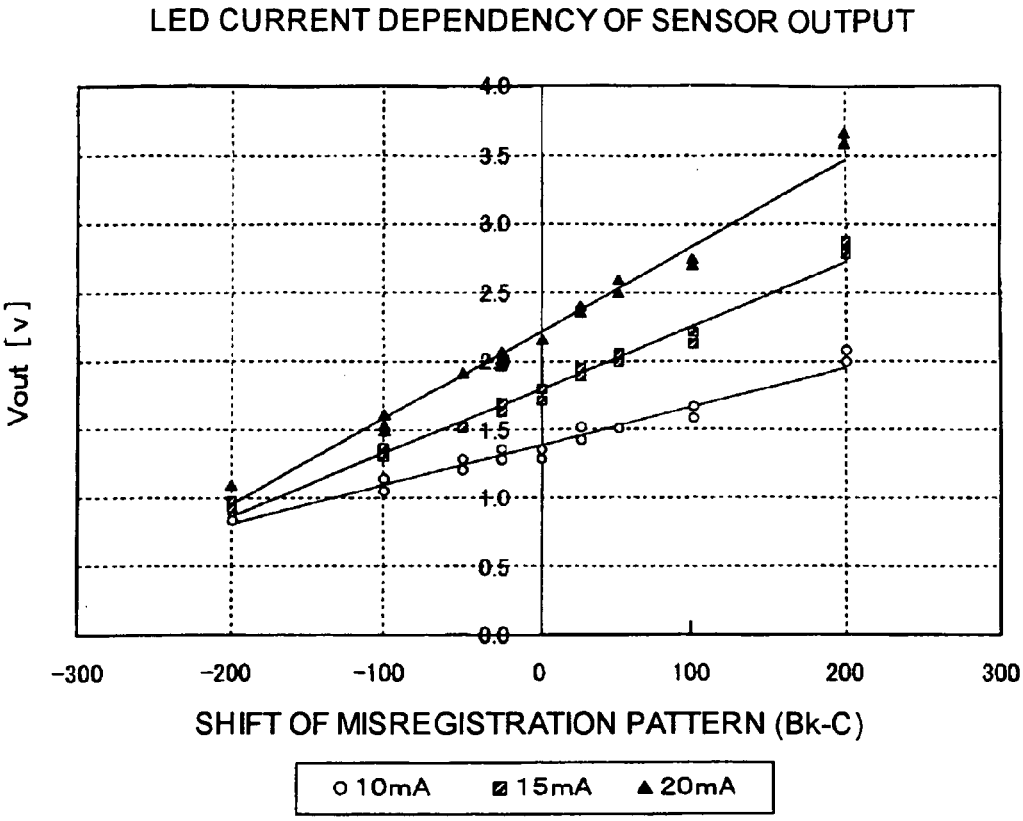
FIG. 29 depicts LED current dependency of the sensor output.

If a method of calculating the amount of out of color registration by determining the intersection of these two segments is adopted, very stable misalignment (out of color registration) correction can be performed, without the influence of dependency of the output value from the sensor fitted surface with respect to the distance as shown in FIG. 28, or the influence of dependency of the output value with respect to the LED current set value as shown in FIG. 29.

Figure 34:
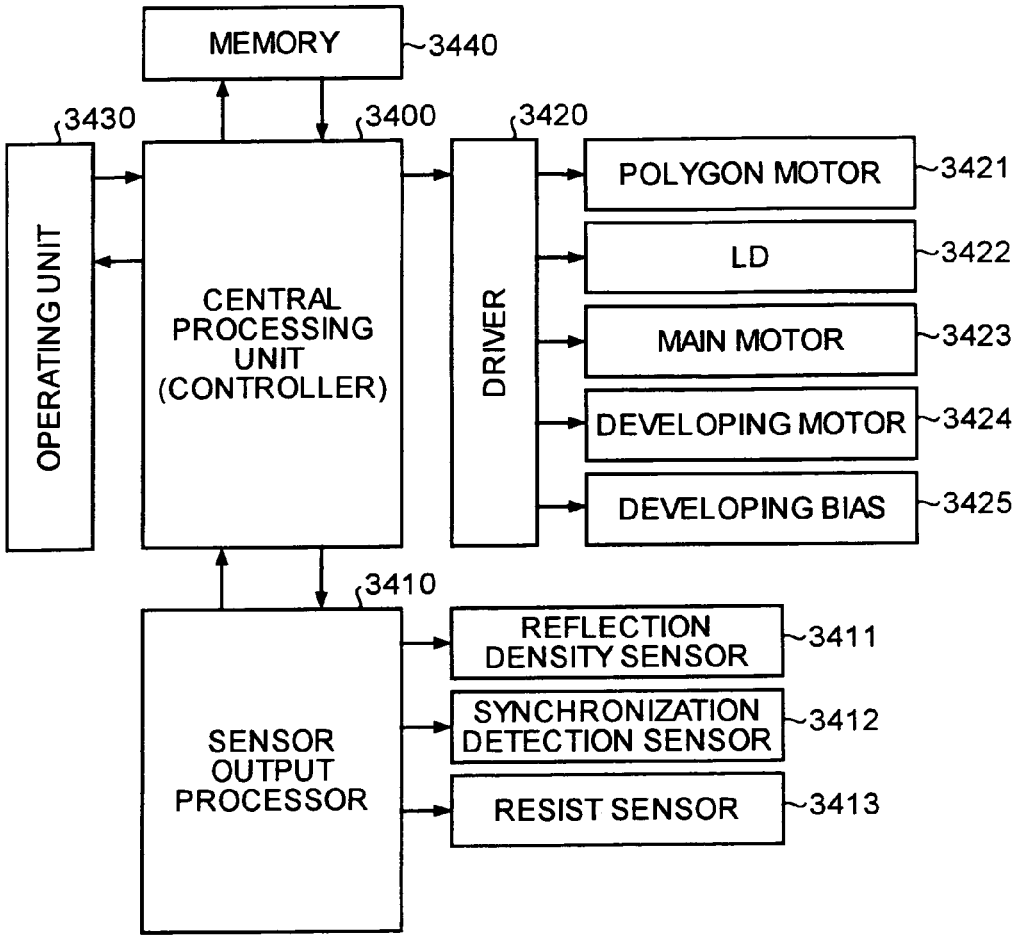
FIG. 34 is a block diagram of a control system of the image forming apparatus according to the third embodiment.

The control of formation of a misalignment correction pattern P, pattern detection, and correction of misalignment based on the detected pattern is executed by a CPU in the CPU 3400 in the control circuit shown in FIG. 34. FIG. 34 is a schematic block diagram of the entire configuration of the control circuit in the image forming apparatus. In this figure, the control circuit includes the CPU 3400, a sensor output processor 3410, a driver 3420, an operating unit 3430, and a memory 3440. The sensor output processor 3410, the operating unit 3430, and the memory 3440 mutually communicate with the CPU 3400, and the driver 3420 drives the respective units according to the instruction from the CPU 3400.

The respective units includes a polygon motor 3421, a laser diode (LD) 3422, a main motor 3423, a developing motor 3424, and a developing bias 3425, and are driven by the drive output of the driver 3420. The sensor output processor 3410 controls sensors such as a reflection density sensor 3411, a synchronization sensor 3412, and a resist sensor 3413, and converts the detection output to digital data and transmits the data to the CPU 3400. The reflection density sensor 3411 corresponds to the out of color registration sensor 1940 (the reflection-type photosensor 3300 in FIG. 33) including the first photodetector 3302 that receives the regular reflection components, and the second photodetector 3303 that receives the diffuse reflection components, and also includes the LED 3301. The synchronization sensor 3412 is for setting the optical write start position at the time of optical write, and the resist sensor 3413 is for setting the transportation timing of the transfer paper to the transfer unit, at the time of transferring the image to the recording medium (transfer paper).

The driver 3420 controls the polygon motor 3421 that rotates the polygon mirror for optical scanning, the LD 3422 that emits laser beams for performing optical write, the main motor 3423 that drives the photosensitive drums 1914 and the transfer belt 1918, the developing motor 3424 that drives the developing apparatus, and the developing bias 3425.

The memory 3440 stores image data for forming the image, and a copy instruction, a detection instruction of misalignment, and a correction instruction of misalignment are provided from the operating unit 3430.

The CPU 3400 uses the RAM (not shown) as a work area according to the program stored in the ROM (not shown), to execute the program stored in the ROM, thereby performing predetermined control.

The program includes a first procedure for forming a plurality of correction target color patterns (lines indicated by hatching in FIGS. 20 and 22) on the transfer belt 1918, along the rotation direction of the transfer belt 1918, a second procedure for forming a plurality of reference color patterns (lines indicated by halftone dots in FIGS. 20 and 22) on the transfer belt 1918 and the correction target color patterns formed on the transfer belt, a third procedure for optically detecting the output from the correction target color patterns with respect to the reference color patterns by the reflection-type photosensor 3300 shown in FIG. 33, a fourth procedure for calculating the amount of misalignment by the CPU shown in FIG. 34 based on the output detected in the third procedure, and a fifth procedure for correcting the amount of misalignment calculated in the fourth procedure by the CPU to perform optical write. The program is loaded into the storage unit (not shown), to perform these procedures by the CPU, thereby correcting the misalignment.

At this time, in the first procedure, the correction target colors are formed in lines at a predetermined pitch in the correction target color pattern, and in the second procedure, the reference color patterns by the black toner are formed in lines at the same pitch as the correction target color patterns, on the correction target color patterns. The first and the second procedures include a procedure in which a plurality of patches are formed by shifting the correction target color patterns with respect to the reference color patterns by an optional amount in the pitch direction of the lines, and by designating a position where the correction target color patterns are completely superposed on the reference color patterns, or completed shifted from the reference color patterns, as a reference position, the patches are continuously arrayed with respect to the read direction of the sensor, so that at least one patch is located at the opposite sides of the reference position.

These programs are written in a recording medium represented by an floppy disk (FD), a CD-ROM, and the like, and are read by a computer from the recording medium, or downloaded from a server via a communicating unit, to become an executable state.

The respective steps corresponding to the respective procedures are executed based on these procedures, thereby enabling the misalignment correction processing based on the misalignment correction pattern.

According to the present embodiment, the following effects can be exhibited:

(1) Even when the transfer belt 1918 is formed of a belt having a poor surface nature (hard to obtain S/N with respect to the regular reflection) such as an elastic belt, misalignment can be detected highly accurately;

(2) By using the reflection-type photosensor 3300 as the sensor, misalignment detection can be controlled accurately and at a low cost;

(3) When the photodetector 3302 that detects the regular reflection components is provided, by setting the gloss level (Gs) of the transfer belt 1918 arranged opposite to the photodetector 3302 to be equal to or more than 60, the regular reflectance can be increased. As a result, the output of the photodetector 3302 with respect to the belt background of the transfer belt 1918 is increased, thereby enabling accurate misalignment detection and correction;

(4) By using the reflection-type photosensor 3300 including the photodetector 3303 that detects diffused components and the photodetector 3302 that detects the regular reflection components with respect to one LED 3301, correction of quantity of light of the LED 3301 can be performed accurately, thereby maintaining the accuracy of the photodetector 3303 that detects diffused components;

(5) When the photodetector 3302 that detects the regular reflection components is provided, since a change in gloss level (ΔGS) in the circumferential direction of the transfer belt 1918 largely affects the sensor output, the variation in the circumferential direction is suppressed within 10 in width, so that a difference in detection due to a change in gloss level can be reduced, and the effect of (3) can be further improved;

(6) When the sensor has the photodetector 3303 that detects the diffuse reflection components with respect to the light emission from the LED 3301, by setting the lightness of the transfer belt 1918 arranged opposite to the photodetector 3303 to $L^* \leqq 25$, the sensitivity of the photodetector 3303 with respect to the transfer belt 1918 and the color toner increases, thereby making the output difference large. As a result, misalignment detection and correction can be performed highly accurately; and (7) When the sensor has the photodetector 3303 that detects the diffuse reflection components with respect to the light emission from the LED 3301, since a change in lightness ($\Delta L^*$) of the transfer belt 1918 in the circumferential direction largely affects the sensor output, by suppressing the change in the circumferential direction within 10 in width, a difference in detection due to a change in gloss level decreases in addition to the effect of (6), thereby further improving the effect of (6).

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a reference-pattern detecting transfer-body to which a reference pattern image formed on an intermediate transfer body is transferred directly without a recording material, the reference-pattern detecting transfer-body arranged opposite to an intermediate transfer body in a secondary transfer unit in which images formed on a plurality of image carriers are transferred onto the intermediate transfer body, and an image formed on the intermediate transfer body is transferred onto the recording material;

a reference-pattern detecting unit that detects the reference pattern transferred onto the reference-pattern detecting transfer-body; and a condition changing unit that changes conditions for forming an image based on a result of detection by the reference-pattern detecting unit.

2. The image forming apparatus according to claim 1, wherein the reference-pattern detecting transfer-body is in electrically grounded state when the reference pattern is transferred.

3. The image forming apparatus according to claim 2, further comprising a bias applying unit that applies a first transfer bias to a secondary transfer opposing member that is arranged opposite to the reference-pattern detecting transfer-body and abutting against a backside of the intermediate transfer body.

4. The image forming apparatus according to claim 3, wherein when the image on the intermediate transfer body is transferred to the reference-pattern detecting transfer-body, the bias applying unit applies a second transfer bias that is different from a transfer bias applied when the image is transferred to the recording material in the secondary transfer unit.

5. The image forming apparatus according to claim 1, wherein the intermediate transfer body is provided with the secondary transfer opposing member having lower hardness than the reference-pattern detecting transfer-body on a backside.

6. The image forming apparatus according to claim 1, wherein a gloss level of the reference-pattern detecting transfer-body in a surface axial direction is equal to or more than 60.

7. The image forming apparatus according to claim 1, wherein a lightness of a surface layer of the reference-pattern detecting transfer-body in a surface axial direction is equal to or less than 30.

* * * * *